US011067315B2

(12) United States Patent
Yamawaki et al.

(10) Patent No.: US 11,067,315 B2
(45) Date of Patent: Jul. 20, 2021

(54) TEMPERATURE CONTROL SYSTEM

(71) Applicant: SHINWA CONTROLS CO., LTD, Kawasaki (JP)

(72) Inventors: Masakatsu Yamawaki, Kawasaki (JP); Teiichirou Ueda, Kawasaki (JP); Shigehiko Ono, Kawasaki (JP); Ryoji Ichiyama, Kawasaki (JP)

(73) Assignee: Shinwa Controls Co., Ltd, Kawasaki (JP)

( * ) Notice: Subject to any disclaimer, the term of this patent is extended or adjusted under 35 U.S.C. 154(b) by 48 days.

(21) Appl. No.: 16/606,444

(22) PCT Filed: Mar. 1, 2019

(86) PCT No.: PCT/JP2019/007993
§ 371 (c)(1),
(2) Date: Oct. 18, 2019

(87) PCT Pub. No.: WO2020/095464
PCT Pub. Date: May 14, 2020

(65) Prior Publication Data

US 2021/0116151 A1 Apr. 22, 2021

(30) Foreign Application Priority Data

Nov. 7, 2018 (WO) ..... PCT/JP2018/041324
Dec. 27, 2018 (WO) ..... PCT/JP2018/048186

(51) Int. Cl.
*F25B 7/00* (2006.01)
*F25B 1/10* (2006.01)
*F25B 5/02* (2006.01)

(52) U.S. Cl.
CPC ..... *F25B 7/00* (2013.01); *F25B 1/10* (2013.01); *F25B 5/02* (2013.01);
(Continued)

(58) Field of Classification Search
CPC ..... F25B 1/10; F25B 7/00; F25B 5/02; F25B 2339/047; F25B 2400/0409;
(Continued)

(56) References Cited

U.S. PATENT DOCUMENTS 2,680,956 A * 6/1954 Haas ..... F25B 7/00 62/175
4,028,079 A 6/1977 Scheibel
(Continued)

FOREIGN PATENT DOCUMENTS

CN 101865589 A 10/2010
CN 104833087 A 8/2015
(Continued)

OTHER PUBLICATIONS

International Search Report and Written Opinion (Application No. PCT/JP2019/007993) dated May 14, 2019.
(Continued)

*Primary Examiner* — Jianying C Atkisson
*Assistant Examiner* — Miguel A Diaz
(74) *Attorney, Agent, or Firm* — Burr & Brown, PLLC

(57) ABSTRACT

A temperature control system includes: first and second refrigerator units; a first fluid flow apparatus that allows a first fluid to flow therethrough and that is cooled by the first refrigerator unit; a second fluid flow apparatus that allows a second fluid to flow therethrough and that is cooled by the second refrigerator unit; and a valve unit that is configured to allow the first fluid or the second fluid to selectively flow out therefrom. The first refrigerator unit has, in a medium-temperature-side refrigerator, a medium-temperature-side first expansion valve and a medium-temperature-side second expansion valve. A medium-temperature-side second evaporator corresponding to the medium-temperature-side second expansion valve and a low-temperature-side condenser of a
(Continued)

low-temperature-side refrigerator constitute a cascade condenser. The first fluid is cooled by a medium-temperature-side first evaporator corresponding to the medium-temperature-side first expansion valve, and is then cooled by a low-temperature-side evaporator of the low-temperature-side refrigerator.

7 Claims, 8 Drawing Sheets

(52) U.S. Cl.
CPC . *F25B 2339/047* (2013.01); *F25B 2400/0409* (2013.01); *F25B 2600/2513* (2013.01); *F25B 2700/21152* (2013.01); *F25B 2700/21161* (2013.01)

(58) Field of Classification Search
CPC .... F25B 2600/2513; F25B 2700/21152; F25B 2700/21161
See application file for complete search history.

(56) References Cited

U.S. PATENT DOCUMENTS

| | | | | |
|---|---|---|---|---|
| 4,484,449 | A * | 11/1984 | Muench | F25B 7/00 318/112 |
| 4,987,750 | A * | 1/1991 | Meckler | F02G 1/043 62/238.6 |
| 9,003,817 | B2 * | 4/2015 | Endoh | F24D 11/0221 62/175 |
| 9,664,424 | B2 * | 5/2017 | Hinde | F25B 31/004 |
| 10,928,103 | B2 * | 2/2021 | Yamawaki | F25B 25/005 |
| 2012/0016508 | A1 | 1/2012 | Matsuzaki et al. | |
| 2012/0180508 | A1 * | 7/2012 | Endoh | F25B 29/003 62/159 |
| 2012/0186284 | A1 * | 7/2012 | Choi | F25B 7/00 62/115 |
| 2012/0285188 | A1 * | 11/2012 | Honda | F25B 7/00 62/160 |
| 2012/0297806 | A1 * | 11/2012 | Honda | F25B 30/02 62/222 |
| 2013/0180276 | A1 * | 7/2013 | Choi | F25B 7/00 62/190 |
| 2014/0013790 | A1 * | 1/2014 | Asari | F25B 1/00 62/335 |
| 2014/0262199 | A1 | 9/2014 | Kobayashi et al. | |
| 2016/0018135 | A1 | 1/2016 | Yuzawa et al. | |
| 2016/0076821 | A1 * | 3/2016 | Kopko | F25B 7/00 165/10 |
| 2017/0021698 | A1 * | 1/2017 | Hatakeyama | B60H 1/143 |
| 2017/0089614 | A1 * | 3/2017 | Miyagi | F25B 5/02 |
| 2018/0017292 | A1 | 1/2018 | Yana Motta et al. | |
| 2018/0347863 | A1 | 12/2018 | Tamaoki et al. | |
| 2019/0017949 | A1 | 1/2019 | Higashida et al. | |
| 2020/0300511 | A1 * | 9/2020 | Yamawaki | F25B 49/02 |

FOREIGN PATENT DOCUMENTS

| | | | | |
|---|---|---|---|---|
| CN | 205002436 | U | 1/2016 | |
| CN | 108317760 | A | 7/2018 | |
| CN | 108603694 | A | 9/2018 | |
| DE | 199 07 435 | A1 | 8/2000 | |
| DE | 101 21 544 | A1 | 11/2002 | |
| EP | 1 772 686 | A2 | 4/2007 | |
| EP | 3 296 664 | A1 | 3/2018 | |
| JP | S58-178160 | A1 | 10/1983 | |
| JP | H03-263556 | A1 | 11/1991 | |
| JP | 04-222355 | A1 | 8/1992 | |
| JP | 06-174388 | A1 | 6/1994 | |
| JP | 2007-078211 | A1 | 3/2007 | |
| JP | 2012-033188 | A1 | 2/2012 | |
| JP | 2014-062701 | A1 | 4/2014 | |
| JP | 2015-215109 | A1 | 12/2015 | |
| JP | 2016-053456 | A1 | 4/2016 | |
| WO | 2010/113875 | A1 | 10/2010 | |
| WO | WO-2012161325 | A1 * | 11/2012 | F25B 9/006 |
| WO | 2013/073537 | A1 | 5/2013 | |
| WO | WO-2013080297 | A1 * | 6/2013 | F25B 7/00 |
| WO | 2017/141722 | A1 | 8/2017 | |
| WO | 2018/221233 | A1 | 12/2018 | |

OTHER PUBLICATIONS

International Search Report and Written Opinion (Application No. PCT/JP2018/041324) dated Jan. 22, 2019.
International Search Report and Written Opinion (Application No. PCT/JP2018/048186) dated Mar. 26, 2019.
International Search Report and Written Opinion (Application No. PCT/JP2021/002565) dated Mar. 9, 2021.
Chinese Office Action (Application No. 201980001940.3) dated Apr. 25, 2021 (with English translation).

* cited by examiner

TEMPERATURE CONTROL SYSTEM

FIELD OF THE INVENTION

An embodiment of the present invention relates to a temperature control system that cools a fluid by a refrigeration apparatus of a heat pump type, and controls a temperature of an object whose temperature is to be controlled (temperature control object) by means of the cooled fluid.

BACKGROUND ART

JP2014-97156 discloses a ternary refrigeration apparatus.

A ternary refrigeration apparatus comprises a high-temperature-side refrigerator, a medium-temperature-side refrigerator and a low-temperature-side refrigerator, each having a compressor, a condenser, an expansion valve and an evaporator. The high-temperature-side refrigerator circulates a high-temperature-side refrigerant, the medium-temperature-side refrigerator circulates a medium-temperature-side refrigerant, and the low-temperature-side refrigerator circulates a low-temperature-side refrigerator. In such a ternary refrigeration apparatus, a high-medium side cascade condenser, which heat-exchanges the high-temperature-side refrigerant and the medium-temperature-side refrigerant, is composed of the evaporator of the high-temperature-side refrigerator and the condenser of the medium-temperature-side refrigerator. A medium-low side cascade condenser, which heat-exchanges the medium-temperature-side refrigerant with the low-temperature-side refrigerant, is composed of the evaporator of the medium-temperature-side refrigerator and the condenser of the low-temperature-side refrigerator. A temperature of an object to be controlled can be controlled down to an extremely low temperature, by means of the evaporator of the low-temperature-side refrigerator.

In addition, a temperature control system has been conventionally known, which cools a fluid such as a brine by the evaporator of the low-temperature-side refrigerator of the aforementioned ternary refrigeration apparatus, and controls a temperature of an object to be controlled by the cooled fluid. Such a temperature control system is sometimes sued for controlling a temperature of a semiconductor manufacturing apparatus. Along with recent miniaturization of semiconductors, a temperature control system for a semiconductor manufacturing apparatus is required to more improve temperature control precision.

SUMMARY OF THE INVENTION

A ternary refrigeration apparatus may need a high-performance compressor in each refrigerator, in order to stably cool a temperature control object down to a target cooled temperature. In particular, a compressor of a low-temperature-side refrigerator may need, in addition to high performance, a special structure for ensuring durability (cold tolerance) against a low-temperature-side refrigerant having an extremely low temperature. Thus, there is a possibility that an overall size of the apparatus excessively increases, and that a manufacturing cost increases and a construction period is extended because of unavailability of compressors.

On the other hand, the temperature control system that performs temperature control by mans of a fluid cooled by the ternary refrigeration apparatus may be required to perform an operation pattern in which a temperature of a temperature control object is controlled to an extremely low temperature (−70° C.) and to a temperature somewhat higher than it (e.g., −20° C. to 20° C.) in a repeated and quick manner. This operation pattern can be achieved by adjusting refrigeration capacity of an evaporator of a cool temperature side refrigerator of a ternary refrigeration apparatus, or by heating a fluid by a heater. However, this lacks in quickness.

The present invention has been made in view of the above circumstances. The object of the present invention is to provide a temperature control system that can easily and stably realize cooling down to an extremely low temperature, and further can quickly perform switching of temperature controls of large temperature difference within a temperature control range including a temperature region down to an extremely low temperature.

A temperature control system according to one embodiment of the present invention is a temperature control system comprising:

a first refrigerator unit;

a second refrigerator unit;

a first fluid flow apparatus that allows a first fluid to flow therethrough wherein the first fluid is cooled by the first refrigerator unit;

a second fluid flow apparatus that allows a second fluid to flow therethrough wherein the second fluid is cooled by the second refrigerator unit; and a valve unit that is configured to receive the first fluid from the first fluid flow apparatus and to receive the second fluid from the second fluid flow apparatus, and is configured to allow any of the first fluid and the second fluid to selectively flow out therefrom;

wherein:

the first refrigerator unit comprises:

a high-temperature-side refrigerator having a high-temperature-side refrigeration circuit in which a high-temperature-side compressor, a high-temperature-side condenser, a high-temperature-side expansion valve and a high-temperature-side evaporator are connected such that a high-temperature-side refrigerant circulates therethrough in this order;

a medium-temperature-side refrigerator having a medium-temperature-side circuit in which a medium-temperature-side compressor, a medium-temperature-side condenser, a medium-temperature-side first expansion valve and a medium-temperature-side first evaporator are connected such that a medium-temperature-side refrigerant circulates therethrough in this order, the medium-temperature-side refrigerator having a cascade bypass circuit including: a branch channel that is branched from a part of the medium-temperature-side refrigeration circuit, which part is on the downstream side of the medium-temperature-side condenser and on the upstream side of the medium-temperature-side first expansion valve, and is connected to a part which is on the downstream side of the medium-temperature-side first evaporator and on the upstream side of the medium-temperature-side compressor, the branch channel allowing the medium-temperature-side refrigerant branched from the medium-temperature-side refrigeration circuit to flow therethrough; a medium-temperature-side second expansion valve provided on the branch channel; and a medium-temperature-side second evaporator provided on the branch channel on the downstream side of the medium-temperature-side second expansion valve; and a low-temperature-side refrigerator having a low-temperature-side refrigeration circuit in which a low-temperature-side compressor, a low-temperature-side condenser, a low-temperature-side expansion valve and a low-temperature-side evaporator are connected such that a low-temperature-side refrigerant circulates therethrough in this order;

wherein:

the high-temperature-side evaporator of the high-temperature-side refrigerator and the medium-temperature-side condenser of the medium-temperature-side refrigerator constitute a first cascade condenser capable of heat-exchanging the high-temperature-side refrigerant with the medium-temperature-side refrigerant;

the medium-temperature-side second evaporator of the medium-temperature-side refrigerator and the low-temperature-side condenser of the low-temperature-side refrigerator constitute a second cascade condenser capable of heat-exchanging the medium-temperature-side refrigerant with the low-temperature-side refrigerant;

when cooling the first fluid, the first refrigerator unit is configured to open both the medium-temperature-side first expansion valve and the medium-temperature-side second expansion valve, so that the first fluid is cooled by the medium-temperature-side first evaporator of the medium-temperature-side refrigerator, and is then cooled by the low-temperature-side evaporator of the low-temperature-side refrigerator;

the second refrigerator unit has a second-side refrigeration circuit in which a second-side compressor, a second-side condenser, a second-side expansion valve and a second-side evaporator are connected such that a second-side refrigerant circulates therethrough in this order, the second refrigerator unit being configured to cool the second fluid by the second-side evaporator; and a boiling point of the low-temperature-side refrigerant is lower than a boiling point of the second-side refrigerant.

In the aforementioned temperature control system, the first fluid allowed to flow by the first fluid flow apparatus is cooled (precooled) by the medium-temperature-side first evaporator of the medium-temperature-side refrigerator, and is then cooled by the low-temperature-side evaporator of the low-temperature-side refrigerator, which can output a refrigeration capacity larger than that of the medium-temperature-side first evaporator. Thus, in order to realize of cooling a temperature control object (first fluid) down to a target desired temperature, the temperature control system can be more easily manufactured than a simple ternary refrigeration apparatus employing a high-performance compressor in the low-temperature-side refrigerator. To be specific, since the low-temperature-side compressor of the low-temperature-side refrigerator can be particularly simplified, cooling of a temperature control object down to a desired temperature set in an extremely low temperature region can be easily and stably realized.

In addition, the second fluid is thermally controlled by the second refrigerator unit separate from the first refrigerator unit such that the second fluid has a temperature lower than that of the first fluid. The first fluid and the second fluid controlled to have different temperatures are selectively switched by the valve unit to flow out therefrom, whereby switching of temperature controls of large temperature difference within a temperature control range including a temperature region down to an extremely low temperature can be quickly performed.

Thus, the present invention can easily and stably realize cooling down to an extremely low temperature, and further can quickly perform switching of temperature controls of large temperature difference within a temperature control range including a temperature region down to an extremely low temperature.

The temperature control system according to this embodiment of the present invention may further comprise a cooling water flow apparatus that allows cooling water to flow therethrough;

wherein:

the cooling water flow apparatus has a first cooling pipe and a second cooling pipe that are branched from a common pipe;

the high-temperature-side condenser cools the high-temperature-side refrigerant by the cooling water flowing out from the first cooling pipe; and the second-side condenser cools the second-side refrigerant by the cooling water flowing out from the second cooling pipe.

In this structure, since the high-temperature-side evaporator and the second-side evaporator can share a common cooling system, the temperature control system can be prevented from being complicated and expensive.

The temperature control system according to this embodiment of the present invention may further comprise:

a third refrigerator unit; and a third fluid flow apparatus that allows a third fluid to flow therethrough wherein the third fluid is cooled by the third refrigerator unit;

wherein:

the third refrigerator unit has a third-side refrigeration circuit in which a third-side compressor, a third-side condenser, a third-side expansion valve and a third-side evaporator are connected such that a third-side refrigerant circulates therethrough in this order, the third refrigerator unit being configured to cool the third fluid by the third-side evaporator;

the cooling water flow apparatus further has a third cooling pipe branched from the common pipe; and the third-side condenser cools the third-side refrigerant by mans of the cooling water flowing out from the third cooling pipe.

In this structure, temperature control pattern variations can be increased by the third fluid flow apparatus, and since the high-temperature-side condenser, the second-side condenser and the third-side condenser can share a common cooling system, even though the third fluid flow apparatus is provided, the temperature control system can be prevented from being complicated and expensive as much as possible.

The valve unit may have:

a first supply channel that allows the first fluid flowing into a first inlet port to flow therethrough and to flow out from a first outlet port;

a first supply-side solenoid switching valve that is switched between an opened state and a closed state, so as to switch flow and shut-off of the first fluid in the first supply channel;

a first branch channel that is branched from a part on the upstream side of the first supply-side solenoid switching valve of the first supply channel, the first branch channel allowing the first fluid flowing from the first supply channel to flow therethrough;

a first branch-side solenoid switching valve that is switched between an opened state and a closed state, so as to switch flow and shut-off of the first fluid in the first branch channel;

a second supply channel that allows the second fluid flowing into a second inlet port to flow therethrough and to flow out from a second outlet port;

a second supply-side solenoid switching valve that is switched between an opened state and a closed state, so as to switch flow and shut-off of the second fluid in the second supply channel;

a second branch channel that is branched from a part on the upstream side of the second supply-side solenoid switching valve of the second supply channel, the second branch channel allowing the second fluid flowing from the second supply channel to flow therethrough;

a second branch-side solenoid switching valve that is switched between an opened state and a closed state, so as to switch flow and shut-off of the second fluid in the second branch channel;

a reception channel that receives the first fluid that flows out from the first outlet port and then returns via a predetermined area, or the second fluid that flows out from the second outlet port and then returns via the predetermined area;

a first circulation channel and a second circulation channel that are biforked from the reception channel;

a first circulation-side solenoid switching valve that switches an opened state and a closed state of the first circulation channel; and a second circulation solenoid switching valve that switches an opened state and a closed state of the second circulation channel.

In this structure, when the state in which the first fluid is flowed out to the state in which the second fluid is flowed out, and vice versa, since the valves for switching the fluid flows are solenoid switching valves, the first fluid supply state and the the second fluid supply state can be quickly switched by supplying and breaking current. In addition, since the valve for switching the fluid flows is a solenoid switching valve, a caliber of the valve seat can be increased as compared with a proportional solenoid valve. Thus, a liquid at a high flowrate can be properly opened/closed. In addition, as compared with a case in which a proportional solenoid calve is used, leakage of liquid can be suppressed. Thus, fluids (first fluid and second fluid) of different temperatures can be quickly switched and supplied, as well as temperature variation of a fluid to be supplied can be prevented.

In the temperature control system according to this embodiment of the present invention, the medium-temperature-side refrigerant and the low-temperature-side refrigerant may be the same.

In the present invention, since the medium-temperature-side first evaporator to which the medium-temperature-side refrigerant is supplied, and the low-temperature-side evaporator to which the low-temperature-side refrigerant is supplied, are not intended to control the first fluid to have different temperatures, the medium-temperature-side refrigerant and the low-temperature-side refrigerant can be the same. Thus, the first fluid can be quickly cooled down to an extremely low temperature. On the other hand, upon start-up, when the first fluid has a normal temperature, for example, degrees of superheat of the medium-temperature-side refrigerant and the low-temperature-side refrigerant are likely to excessively increase to invite trouble in operation. This problem can be solved by cooling the temperature control object by the second fluid cooled by the second refrigerator unit, and by passing the first fluid through the cooled temperature control object so as to cool the first fluid.

The medium-temperature-side refrigerator may further have a cascade cooling circuit having: a cooling channel that is branched from a part of the medium-temperature-side refrigeration circuit, which part is on the downstream side of the medium-temperature-side condenser and on the upstream side of the medium-temperature-side first expansion valve, and is connected to a part of the cascade bypass circuit, which part is on the downstream side of the medium-temperature-side second evaporator, the cooling channel allowing the medium-temperature-side refrigerant branched from the medium-temperature-side refrigeration circuit to flow therethrough; and a medium-temperature-side third expansion valve provided on the cooling channel.

In this structure, the cascade cooling circuit can regulate a temperature of the medium-temperature-side refrigerant flowing out from the medium-temperature-side second evaporator, by mixing the medium-temperature-side refrigerant flowing out from the medium-temperature-side second evaporator and the medium-temperature-side refrigerant expanded in the medium-temperature-side third expansion valve so as to have a low temperature and a low pressure, whereby a temperature of the medium-temperature-side refrigerant flowing out from the medium-temperature-side first evaporator and a temperature of the medium-temperature-side refrigerant flowing out from the medium-temperature-side second evaporator can be made generally equal. In this embodiment, since the medium-temperature-side first evaporator and the medium-temperature-side second evaporator cool the fluids different from each other (first fluid and low-temperature-side refrigerant), there is a possibility that a temperature of the medium-temperature-side refrigerant flowing out from the medium-temperature-side first evaporator and a temperature of the medium-temperature-side refrigerant flowing out from the medium-temperature-side second evaporator differ from each other. When this situation occurs, by making equal a temperature of the medium-temperature-side refrigerant flowing out from the medium-temperature-side first evaporator and a temperature of the medium-temperature-side refrigerant flowing out from the medium-temperature-side second evaporator, a burden on the medium-temperature-side refrigerator, which may be caused when the medium-temperature-side refrigerants having quite different temperatures are mixed, can be lessened. Thereby, the medium-temperature-side refrigerator can be prevented from being damaged.

In the temperature control system according to this embodiment of the present invention, a part of the low-temperature-side refrigeration circuit, which part is on the downstream side of the low-temperature-side condenser and on the upstream side of the low-temperature-side expansion valve, and a part of the low-temperature-side refrigeration circuit, which part is on the downstream side of the low-temperature-side evaporator and on the upstream side of the low-temperature-side compressor, may constitute an internal heat exchanger capable of heat-exchanging the low-temperature-side refrigerant passing through the former part with the low-temperature-side refrigerant passing through the latter part.

In such a structure, increase in degree of superheat of the low-temperature-side refrigerant, which may occur upon start-up, can be reduced by the internal heat exchanger.

Such a temperature control system of the present invention can easily and stably realize cooling down to an extremely low temperature, and further can quickly perform switching of temperature controls of large temperature difference within a temperature control range including a temperature region down to an extremely low temperature.

DETAILED DESCRIPTION OF THE INVENTION

An embodiment of the present invention will be described in detail herebelow with reference to the attached drawings.

Figure 1:
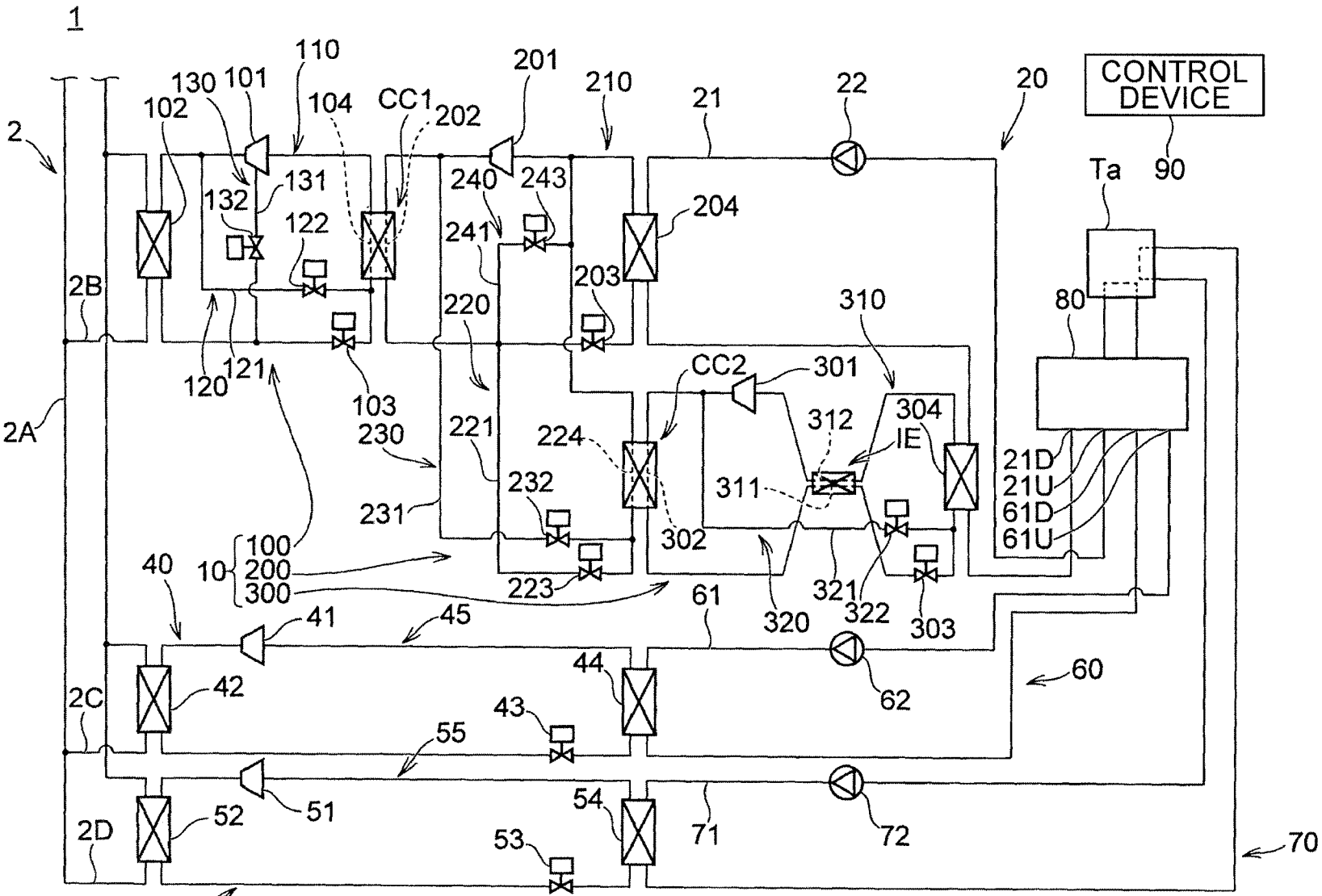
FIG. 1 is a schematic view of a temperature control system according to one embodiment.

FIG. 1 is a schematic view of a temperature control system 1 according to an embodiment of the present invention. The temperature control system 1 according to this embodiment comprises a first refrigerator unit 10, a second refrigerator unit 40, a third refrigerator unit 50, a first fluid flow apparatus 20 that allows a first fluid to flow therethrough, a second fluid flow apparatus 60 that allows a second fluid to flow therethrough, a third fluid flow apparatus 70 that allows a third fluid to flow therethrough, a valve unit 80 and a control device 90. The first fluid is cooled by the first refrigerator unit 10, the second fluid is cooled by the second refrigerator unit 40, and the third fluid is cooled by the third refrigerator unit 50.

The temperature control system 1 cools the first fluid allowed to flow by the first fluid flow apparatus 20 by means of the first refrigerator unit 10, and supplies the cooled first fluid from the first fluid flow apparatus 20 to the valve unit 80. In addition, the temperature control system 1 cools the second fluid allowed to flow by the second fluid flow apparatus 40 by means of the second refrigerator unit 40, and supplies the cooled second fluid from the second fluid flow apparatus 60 to the valve unit 80. The valve unit 80 is configured to receive the first fluid from the first fluid flow apparatus 20 and the second fluid from the second fluid flow apparatus 60, and to allow any of the first fluid and the second fluid to selectively flow out therefrom.

The first fluid or the second fluid flowing out from the valve unit 80 is supplied to an object whose temperature is to be controlled (temperature control object) Ta. Then, the first or second fluid controls a temperature of a part of the temperature control object Ta, and thereafter returns to the first fluid flow apparatus 20 or the second fluid flow apparatus 60 through the valve unit 80. In addition, the temperature control system 1 cools the third fluid allowed to flow by the third flow circulation apparatus 70 by means of the third refrigerator unit 50, and supplies the cooled third fluid to the temperature control object Ta so as to control a temperature of another part of the temperature control object Ta. Thereafter, the third fluid returns to the third fluid flow apparatus 70.

In the temperature control system 1 according to this embodiment, a temperature of the first fluid allowed to flow by the first fluid flow apparatus 20 is controlled within a range of from 20° C. to −70° C., preferably to −80° C., a temperature of the second fluid allowed to flow by the second fluid flow apparatus 60 is controlled within a range of from 80° C. to −10° C., and a temperature of the third fluid allowed to flow by the third fluid flow apparatus 70 is controlled within a range of from 150° C. to 10° C. Note that the refrigeration capacity of the temperature control system 1 and a temperature down to which a fluid can be cooled are not particularly limited.

The control device 90 is electrically connected to each refrigerator unit (10, 40, 50), each fluid flow apparatus (20, 60, 70) and the valve unit 80 so as to control operations of them. The control device 90 may be a computer including, for example, a CPU, a ROM, a RAM, etc., and may control operations of the each refrigerator unit (10, 40, 50), each fluid flow apparatus (20, 60, 70) and the valve unit 80 in accordance with a stored computer program. Herebelow, respective components constituting the temperature control system 1 are described in detail.

First Refrigerator Unit

The first refrigerator unit 10 is a ternary refrigeration apparatus comprising a high-temperature-side refrigerator 100, a medium-temperature-side refrigerator 200, and a low-temperature-side refrigerator 300, which are respectively formed as heat pump type refrigerators.

A first cascade condenser CC1 is constituted between the high-temperature-side refrigerator 100 and the medium-temperature-side refrigerator 200, and a second cascade condenser CC2 is constituted between the medium-temperature-side refrigerator 200 and the low-temperature-side refrigerator 300. Thus, the first refrigerator unit 10 can cool the medium-temperature-side refrigerant circulated by the medium-temperature-side refrigerator 200 by means of the high-temperature-side refrigerant circulated by the high-temperature-side refrigerator 100, and can cool the low-temperature-side refrigerant circulated by the low-temperature-side refrigerator 300 by means of the cooled medium-temperature-side refrigerant.

High-Temperature-Side Refrigerator

The high-temperature-side refrigerator 100 has: a high-temperature-side refrigeration circuit 110 in which a high-temperature-side compressor 101, a high-temperature-side condenser 102, a high-temperature-side expansion valve 103 and a high-temperature-side evaporator 104 are connected by pipes such that a high-temperature-side refrigerant circulates therethrough in this order; a high-temperature-side hot gas circuit 120; and a cooling bypass circuit 130.

In the high-temperature-side refrigeration circuit 110, the high-temperature-side compressor 101 compresses the high-temperature-side refrigerant basically in the form of gas, which flows out from the high-temperature-side evaporator 104, and supplies the high-temperature-side condenser 102 with the high-temperature-side refrigerant having an elevated temperature and an elevated pressure. The high-temperature-side condenser 102 cools and condenses, by means of the cooling water, the high-temperature-side refrigerant compressed by the high-temperature-side compressor 101, and supplies the high-temperature-side expansion valve 103 with the high-temperature-side refrigerant in the form of liquid, which has a predetermined temperature and a high pressure.

In this embodiment, the temperature control system 1 further comprises a cooling water flow apparatus 2. The cooling water flow apparatus 2 has a first cooling pipe 2B, a second cooling pipe 2C and a third cooling pipe 2C which are branched from a common pipe 2A. The first cooling pipe 2B is connected to the high-temperature-side condenser 102, so that the high-temperature-side condenser 102 cools the high-temperature-side refrigerant by means of the cooling water flowing out from the first cooling pipe 2B. The cooling water allowed to flow by the cooling water flow apparatus 2 may be water or another refrigerant. In addition, as described below, the second cooing pipe 2C is connected to a second condenser 42 of the second refrigerator unit 40, and the third cooling pipe 2D is connected to a third condenser 52 of the third refrigerator unit 50.

The high-temperature-side expansion valve 103 expands and decompresses the high-temperature-side refrigerant supplied from the high-temperature-side condenser 102, and supplies the high-temperature-side evaporator 104 with the high-temperature-side refrigerant in the form of gas-liquid or liquid, which has a lowered temperature and a lowered pressure as compared with the high-temperature-side refrigerant before being expanded. The high-temperature-side evaporator 104 constitutes the first cascade condenser CC1, together with a below-described medium-temperature-side condenser 202 of the medium-temperature-side refrigerator 200, and cools the medium-temperature-side refrigerant by heat-exchanging the high-temperature-side refrigerant supplied thereto with the medium-temperature-side refrigerant circulated by the medium-temperature-side refrigerator 200. The high-temperature-side refrigerant heat-exchanged with the medium-temperature-side refrigerant has an elevated temperature so as to ideally become the high-temperature-side refrigerant in the form of gas. Then, the high-temperature-side refrigerant flows out from the high-temperature-side evaporator 104 so as to be again compressed by the high-temperature-side compressor 101.

The high-temperature-side hot gas circuit 120 has: a hot gas channel 121 that is branched from a part of the high-temperature-side refrigeration circuit 110, which part is on the downstream side of the high-temperature-side compressor 101 and on the upstream side of the high-temperature-side condenser 102, and is connected to a part which is on the downstream side of the high-temperature-side expansion valve 103 and on the upstream side of the high-temperature-side evaporator 104; and a flowrate regulation valve 122 provided on the hot gas channel 121.

The high-temperature-side hot gas circuit 120 mixes the high-temperature-side refrigerant flowing out from the high-temperature-side compressor 101 and the high-temperature-side refrigerant expanded by the high-temperature-side expansion valve 103, in accordance with opening/closing and opening degree regulation of the flowrate regulation valve 122, so as to regulate the refrigeration capacity of the high-temperature-side evaporator 104. Namely, the high-temperature-side hot gas circuit 120 is provided for controlling a capacity of the high-temperature-side evaporator 104. Due to the provision of the high-temperature-side hot gas circuit 120, the high-temperature-side refrigerator 100 can quickly regulate the refrigeration capacity of the high-temperature-side evaporator 104.

The cooling bypass circuit 130 has: a cooling channel 131 that is branched from a part of the high-temperature-side refrigeration circuit 110, which part is on the downstream side of the high-temperature-side condenser 102 and on the upstream side of the high-temperature-side expansion valve 103, and is connected to the high-temperature-side compressor 101; and a cooling expansion valve 132 provided on the cooling channel 131. The cooling bypass circuit 130 can expand the high-temperature-side refrigerant flowing out from the high-temperature-side condenser 102 so as to cool the high-temperature-side compressor 101 by means of the high-temperature-side refrigerant having a lowered temperature as compared with the high-temperature-side refrigerant before being expanded.

The high-temperature-side refrigerant used in the above high-temperature-side refrigerator 100 is not particularly limited, and is suitably determined in accordance with a target cooling temperature for the temperature control object. In this embodiment, in order to cool the first fluid allowed to flow by the first fluid flow apparatus 20 down to −70° C. or less, preferably down to −80° C. or less, so as to cool the temperature control object by means of the cooled first fluid, R410A is used as the high-temperature-side refrigerant. However, the type of the high-temperature-side refrigerant is not particularly limited. As the high-temperature-side refrigerant, R32, R125, R134a, R407C, HFOs, $CO_2$, ammonia or the like may be used. In addition, the high-temperature-side refrigerant may be a mixed refrigerant. Alternatively, in R410A, R32, R125, R134a, R407C, a mixed refrigerant or the like, an n-pentane-added refrigerant may be used as an oil carrier. When n-pentane is added, lubrication oil for the high-temperature-side compressor 101 can be circulated together with refrigerant, and the high-temperature-side compressor 101 can be stably operated. In addition, propane may be added as an oil carrier.

Medium-Temperature-Side Refrigerator

The medium-temperature-side refrigerator 200 has: a medium-temperature-side refrigeration circuit 210 in which a medium-temperature-side condenser 202, a medium-temperature-side first expansion valve 203 and a medium-temperature-side evaporator 204 are connected by pipes such that a medium-temperature-side refrigerant circulates therethrough in this order; a cascade bypass circuit 220; a medium-temperature-side hot gas circuit 230; and a cascade cooling circuit 240.

In the medium-temperature-side refrigeration circuit 210, the medium-temperature-side compressor 201 compresses the medium-temperature-side refrigerant basically in the form of gas, which flows out from the medium-temperature-side evaporator 204, and supplies the medium-temperature-side condenser 202 with the medium-temperature-side refrigerant having an elevated temperature and an elevated pressure. As described above, the medium-temperature-side condenser 202 constitutes the first cascade condenser CC1 together with the high-temperature-side evaporator 104 of the high-temperature-side refrigerator 100. The medium-temperature-side condenser 202 cools and condenses the medium-temperature-side refrigerant supplied thereto by means of the high-temperature-side refrigerant in the first cascade condenser CC1, and supplies the medium-temperature-side first expansion valve 203 with the medium-temperature-side refrigerant in the form of liquid, which has a predetermined temperature and a high pressure.

The medium-temperature-side first expansion valve 203 expands and decompresses the medium-temperature-side refrigerant supplied from the medium-temperature-side condenser 202, and supplies the medium-temperature-side first evaporator 204 with the medium-temperature-side refrigerant in the form of gas-liquid or liquid, which has a lowered temperature and a lowered pressure as compared with the medium-temperature-side refrigerant before being expanded. The medium-temperature-side first evaporator 204 heat-exchanges the medium-temperature-side refrigerant supplied thereto with the first fluid allowed to flow by the first fluid flow apparatus 20, so as to cool the fluid. The medium-temperature-side refrigerant heat-exchanged with the first fluid allowed to flow by the first fluid flow apparatus 20 has an elevated temperature so as to ideally become the medium-temperature-side refrigerant in the form of gas. Then, the medium-temperature-side refrigerant flows out from the medium-temperature-side first evaporator 204 so as to be again compressed by the medium-temperature-side compressor 201.

The cascade bypass circuit 220 has: a branch channel 221 that is branched from a part of the medium-temperature-side refrigeration circuit 210, which part is on the downstream side of the medium-temperature-side condenser 202 and on the upstream side of the medium-temperature-side first expansion valve 203, and is connected to a part which is on the downstream side of the medium-temperature-side first evaporator 204 and on the upstream side of the medium-temperature-side compressor 201, the branch channel 221 being configured to allow the medium-temperature-side refrigerant branched from the medium-temperature-side refrigeration circuit 210 to flow therethrough; a medium-temperature-side second expansion valve 223 provided on the branch channel 221; and a medium-temperature-side second evaporator 224 provided on the branch channel 221 on the downstream side of the medium-temperature-side second expansion valve 223.

The medium-temperature-side second expansion valve 223 expands and compresses the medium-temperature-side refrigerant branched from the medium-temperature-side refrigeration circuit 210, and supplies the medium-temperature-side second evaporator 224 with the medium-temperature-side refrigerant in the form of gas-liquid or liquid, which has a lowered temperature and a lowered pressure as compared with the medium-temperature-side refrigerant before being expanded. The medium-temperature-side second evaporator 224 constitutes the second cascade condenser CC2 together with a below-described low-temperature-side condenser 302 of the low-temperature-side refrigerator 300. The medium-temperature-side second evaporator 224 heat-exchanges the medium-temperature-side refrigerant supplied thereto with the low-temperature-side refrigerant circulated by the low-temperature-side refrigerator 300, so as to cool the low-temperature-side refrigerant. The medium-temperature-side refrigerant heat-exchanged with the low-temperature-side refrigerant has an elevated temperature so as to ideally become the medium-temperature-side refrigerant in the form of gas, and flows out from the second cascade condenser CC2. Then, the medium-temperature-side refrigerant flowing out from the second cascade condenser CC2 (medium-temperature-side second evaporator 224) merges with the medium-temperature-side refrigerant flowing out from the medium-temperature-side evaporator 204 so as to flow into the medium-temperature-side compressor 201.

The medium-temperature-side hot gas circuit 230 has: a hot gas channel 231 that is branched from a part of the medium-temperature-side refrigeration circuit 210, which part is on the downstream side of the medium-temperature-side compressor 201 and on the upstream side of the medium-temperature-side condenser 202, and is connected to a part of the cascade bypass circuit 220, which part is on the downstream side of the medium-temperature-side second expansion valve 223 and on the upstream side of the medium-temperature-side second evaporator 224; and a flowrate regulation valve 232 provided on the hot gas channel 231.

The medium-temperature-side hot gas circuit 230 mixes the medium-temperature-side refrigerant flowing out from the medium-temperature-side compressor 201 and the medium-temperature-side refrigerant expanded by the medium-temperature-side second expansion valve 223, in accordance with opening/closing and opening degree regulation of the flowrate regulation valve 232, so as to regulate the refrigeration capacity of the medium-temperature-side second cascade condenser CC2 (medium-temperature-side second evaporator 224). Namely, the medium-temperature-side hot gas circuit 230 is provided for controlling a capacity of the second cascade condenser CC2. Due to the provision of the medium-temperature-side hot gas circuit 230, the medium-temperature-side refrigerator 200 can quickly regulate the refrigeration capacity of the second cascade condenser CC2.

In addition, the medium-temperature-side hot gas circuit 230 has a function for maintaining constant a pressure of the refrigerant sucked into the medium-temperature-side compressor 201. In this embodiment, since the medium-temperature-side first evaporator 204 and the medium-temperature-side second evaporator 224 cool the fluids different from each other (first fluid and low-temperature-side refrigerant), there is a possibility that a pressure of the medium-temperature-side refrigerant flowing out from the medium-temperature-side first evaporator 204 and a pressure of the medium-temperature-side refrigerant flowing out from the medium-temperature-side second evaporator 224 differ from each other. When this situation occurs, in this embodiment, the medium-temperature-side hot gas circuit 230 can regulate a pressure of the medium-temperature-side refrigerant flowing out from the medium-temperature-side second evaporator 224, by mixing the medium-temperature-side refrigerant, which flows through a part which is on the downstream side of the medium-temperature-side second expansion valve 223 and on the upstream side of the medium-temperature-side second evaporator 224, and the medium-temperature-side refrigerant having a high temperature and a high pressure. Thus, a pressure of the medium-temperature-side refrigerant flowing out from the medium-temperature-side first evaporator 204 and a pressure of the medium-temperature-side refrigerant flowing out from the medium-temperature-side second evaporator 224 can be made equal. When they have the equal pressures, the medium-temperature-side refrigerant is prevented from being disturbed on the upstream side of the medium-temperature-side compressor 201, whereby decrease in precision of the temperature control can be prevented.

In addition, the cascade cooling circuit 240 has: a cooling channel 241 that is branched from a part of the medium-temperature-side refrigeration circuit 210, which part is on the downstream side of the medium-temperature-side condenser 202 and on the upstream side of the medium-temperature-side first expansion valve 203, and is connected to a part of the cascade bypass circuit 220, which part is on the downstream side of the medium-temperature-side second evaporator 224, the cooling channel 241 allowing the medium-temperature-side refrigerant branched from the medium-temperature-side refrigeration circuit 210 to flow therethrough; and a medium-temperature-side third expansion valve 243 provided on the cooling channel 241.

When a temperature of the medium-temperature-side refrigerant flowing out from the medium-temperature-side second evaporator 224 constituting the second cascade condenser CC2 is higher than a temperature of the medium-temperature-side refrigerant flowing out from the medium-temperature-side first evaporator 204, the cascade cooling circuit 240 has a function for lowering a temperature of the medium-temperature-side refrigerant flowing out from the medium-temperature-side second evaporator 224 constituting the second cascade condenser CC2. In this embodiment, since the medium-temperature-side first evaporator 204 and the medium-temperature-side second evaporator 224 cool the fluids different from each other (first fluid and low-temperature-side refrigerant), there is a possibility that a temperature of the medium-temperature-side refrigerant flowing out from the medium-temperature-side first evaporator 204 and a temperature of the medium-temperature-side refrigerant flowing out from the medium-temperature-side second evaporator 224 differ from each other. When this situation occurs, in this embodiment, the cascade cooling circuit 240 can regulate a temperature of the medium-temperature-side refrigerant flowing out from the medium-temperature-side second evaporator 224, by mixing the medium-temperature-side refrigerant flowing out from the medium-temperature-side second evaporator 224 and the medium-temperature-side refrigerant expanded in the medium-temperature-side third expansion valve 243 so as to have a low temperature and a low pressure. Thus, a temperature of the medium-temperature-side refrigerant flowing out from the medium-temperature-side first evaporator 204 and a temperature of the medium-temperature-side refrigerant flowing out from the medium-temperature-side second evaporator 224 can be made equal. When they have the equal temperatures, a burden on the medium-temperature-side refrigerator 200, which may be caused when the medium-temperature-side refrigerants having quite different temperatures are mixed, can be lessened, whereby the medium-temperature-side refrigerator 200 can be prevented from being damaged.

The medium-temperature-side refrigerant used in the above medium-temperature-side refrigerator 200 is not particularly limited, and is suitably determined in accordance with a target cooling temperature for the temperature control object, similarly to the high-temperature-side refrigerant. In this embodiment, in order to cool the first fluid allowed to flow by the first fluid flow apparatus 20 down to −70° C. or less, preferably down to −80° C. or less, R23 is used as the medium-temperature-side refrigerant. However, the type of the medium-temperature-side refrigerant is not particularly limited.

Low-Temperature-Side Refrigerator

The low-temperature-side refrigerator 300 has: a low-temperature-side refrigeration circuit 310 in which a low-temperature-side compressor 301, a low-temperature-side condenser 302, a low-temperature-side expansion valve 303 and a low-temperature-side evaporator 304 are connected by pipes such that a low-temperature-side refrigerant circulates therethrough; and a low-temperature-side hot gas circuit 320.

In the low-temperature-side refrigeration circuit 310, the low-temperature-side compressor 301 compresses the low-temperature-side refrigerant basically in the form of gas, which flows out from the low-temperature-side evaporator 304, and supplies the low-temperature-side condenser 302 with the low-temperature-side refrigerant having an elevated temperature and an elevated pressure. As described above, the low-temperature-side condenser 302 constitutes the second cascade condenser CC2 together with the medium-temperature-side second evaporator 224 of the medium-temperature-side refrigerator 200. The low-temperature-side condenser 302 cools and condenses the low-temperature-side refrigerant supplied thereto by means of the medium-temperature-side refrigerant in the second cascade condenser CC2, and supplies the low-temperature-side expansion valve 303 with the low-temperature-side in the form of liquid, which has a predetermined temperature and a high pressure.

The low-temperature-side expansion valve 303 expands and decompresses the low-temperature-side refrigerant supplied from the low-temperature-side condenser 302, and supplies the low-temperature-side evaporator 304 with the low-temperature-side refrigerant in the form of gas-liquid or liquid, which has a lowered temperature and a lowered pressure as compared with the low-temperature-side refrigerant before being expanded. The low-temperature-side evaporator 304 heat-exchanges the low-temperature-side refrigerant supplied thereto with the first fluid allowed to flow by the first circulation apparatus 20, so as to cool the fluid. The low-temperature-side refrigerant heat-exchanged with the first fluid allowed to flow by the first fluid flow apparatus 20 has an elevated temperature so as to ideally become the low-temperature-side refrigerant in the form of gas. Then, the low-temperature-side refrigerant flows out from the low-temperature-side evaporator 304 so as to be again compressed by the low-temperature-side compressor 301.

The low-temperature-side hot gas circuit 320 has: a hot gas channel 321 that is branched from a part of the low-temperature-side circuit 310, which part is on the downstream side of the low-temperature-side compressor 301 and on the upstream side of the low-temperature-side condenser 302, and is connected to a part which is on the downstream side of the low-temperature-side expansion valve 303 and on the upstream side of the low-temperature-side evaporator 304; and a flowrate regulation valve 322 provided on the hot gas channel 321.

The low-temperature-side hot gas circuit 320 regulates the refrigeration capacity of the low-temperature-side evaporator 304, by mixing the low-temperature-side refrigerant flowing out from the low-temperature-side compressor 301 and the low-temperature-side refrigerant expanded by the low-temperature-side expansion valve 303, in accordance with opening/closing and opening degree regulation of the flowrate regulation valve 322. Namely, the low-temperature-side hot gas circuit 320 is provided for controlling a capacity of the low-temperature-side evaporator 304. Due to the provision of the low-temperature-side hot gas circuit 320, the low-temperature-side refrigerator 300 can quickly regulate the refrigeration capacity of the low-temperature-side evaporator 304.

In addition, in the low-temperature-side refrigerator 300, a first part 311 of the low-temperature-side refrigeration circuit 310, which part is on the downstream side of the low-temperature-side condenser 302 and on the upstream side of the low-temperature-side expansion valve 303, and a second part 312 of the low-temperature-side refrigeration circuit 310, which part is on the downstream side of the low-temperature-side evaporator 304 and on the upstream side of the low-temperature-side compressor 301, constitute an internal heat exchanger IE capable of heat-exchanging the low-temperature-side refrigerant passing through the first part 311 with the low-temperature-side refrigerant passing through second part 312.

In the internal heat exchanger IE, the low-temperature-side refrigerant that has flown out from the low-temperature-side condenser 302 and is going to flow into the low-temperature-side expansion valve 303, and the low-temperature-side refrigerant that has flown out from the low-temperature-side evaporator 304 and is going to flow into the low-temperature-side compressor 301, are heat-exchanged with each other. Thus, the low-temperature-side refrigerant having flown out from the low-temperature-side condenser 302 can be cooled before it flows into the low-temperature-side expansion valve 303, and the low-temperature-side refrigerant having flown out from the low-temperature-side evaporator 304 can be heated before it flows into the low-temperature-side compressor 301. As a result, the refrigeration capacity of the low-temperature-side evaporator 304 can be easily increased, as well as the burden for ensuring durability (cold tolerance) of the low-temperature-side compressor 301 can be lessened.

The low-temperature-side refrigerant used in the above low-temperature-side refrigerator 300 is not particularly limited, and is suitably determined in accordance with a target cooling temperature for the temperature control object, similarly to the high-temperature-side refrigerant and the medium-temperature-side refrigerant. In this embodiment, in order to cool the first fluid allowed to flow by the first fluid flow apparatus 20 down to −70° C. or less, preferably down to −80° C. or less, R23 is used as the low-temperature-side refrigerant. However, the type of the low-temperature-side refrigerant is not particularly limited.

In this embodiment, although both the medium-temperature-side refrigerator 200 and the low-temperature-side refrigerator 300 use R23, the medium-temperature-side refrigerator 200 and the low-temperature-side refrigerator 300 may use refrigerants different from each other. In addition, in order to realize cooling down to an extremely low temperature, at least one of the medium-temperature-side refrigerator 200 and the low-temperature-side refrigerator 300 may use R1132a in place of R23. Since R1132a has a boiling point of about −83° C. or less, a temperature can be lowered down to −70° C. or less, R1132a is preferably used for performing cooling down to an extremely low temperature. Moreover, since the global warming potential (GWP) of the R1132a is very low, an eco-friendly apparatus can be made.

In addition, in at least any of the medium-temperature-side refrigerator 200 and the low-temperature-side refrigerator 300, a mixed refrigerant containing R23 and another refrigerant, or a mixed refrigerant containing R1132a and another refrigerant may be used.

For example, in at least any one of the medium-temperature-side refrigerator 200 and the low-temperature-side refrigerator 300, a mixed refrigerant in which R1132a and $CO_2$ (R744) are mixed may be used. In this case, handling can be facilitated, while cooling down to an extremely low temperature and suppression of global warming potential can be realized.

In addition, in at least any of the medium-temperature-side refrigerator 200 and the low-temperature-side refrigerator 300, a mixed refrigerant in which R1132a, R744 and R23 are mixed may be used.

In addition, in at least any of the medium-temperature-side refrigerator 200 and the low-temperature-side refrigerator 300, for example, a refrigerant in which n-pentane is added to R23, R1132a, or a mixed refrigerant containing at least any of them, may be used. When n-pentane is added, since it functions as an oil carrier, lubrication oil for the compressors 201, 301 can be suitably circulated together with the refrigerant, and the compressors 201, 301 can be stably operated. In addition, propane may be added as an oil carrier.

As described above, the aforementioned first refrigerator unit 10 heat-exchanges the medium-temperature-side refrigerant supplied to the medium-temperature-side first evaporator 204 with the first fluid allowed to flow by the first fluid flow apparatus 20 so as to cool the fluid, and heat-exchanges the low-temperature-side refrigerant supplied to the low-temperature-side evaporator 304 with the first fluid allowed to flow by the first fluid flow apparatus 20 so as to cool the fluid. At this time, the first refrigerator unit 10 is configured to open both the medium-temperature-side first expansion valve 203 and the medium-temperature-side second expansion valve 223, so that the first fluid is cooled by the medium-temperature-side first evaporator 204 of the medium-temperature-side refrigerator 200, and is then cooled by the low-temperature-side evaporator 304 of the low-temperature-side refrigerator 300. The opening degrees of the medium-temperature-side first expansion valve 203 and the medium-temperature-side second expansion valve 223 are set such that the refrigeration capacity outputted by the medium-temperature-side first evaporator 204 is at least 2 kW or more, and that the refrigeration capacity outputted by the low-temperature-side evaporator 304 is at least 2 kW or more, in this example, 11 kW or more.

Second Refrigerator Unit

The second refrigerator unit 40 has a second-side refrigeration circuit 45 in which a second-side compressor 41, a second-side condenser 42, a second-side expansion valve 43 and a second-side evaporator 44 are connected such that a second-side refrigerant circulates therethrough in this order. The second refrigerator unit 40 is configured to cool the second fluid allowed to flow by the second fluid flow apparatus 60 by means of the second-side evaporator 44.

In the second-side refrigeration circuit 45, the second-side compressor 41 compresses the second-side refrigerant basically in the form of gas, which flows out from the second-side evaporator 44, and supplies the second-side condenser 42 with the second-side refrigerant having an elevated temperature and an elevated pressure. The second-side condenser 42 cools and condenses, by means of the cooling water, the second-side refrigerant compressed by the second-side compressor 41, and supplies the second-side expansion valve 43 with the second-side refrigerant in the form of liquid, which has a predetermined temperature and a high pressure. Here, the second-side condenser 42 is connected to the second cooling pipe 2C of the cooling water flow apparatus 2 so as to cool the second-side refrigerant by means of the cooling water flowing out from the second cooling pipe 2C.

The second-side expansion valve 43 expands and decompresses the second-side refrigerant supplied from the second-side condenser 42, and supplies the second-side evaporator 44 with the second-side refrigerant in the form of gas-liquid or liquid, which has a lowered temperature and a lowered pressure as compared with the second-side refrigerant before being expanded. The second-side evaporator 44 heat-exchanges the second-side refrigerant supplied thereto with the second fluid allowed to flow by the second fluid flow apparatus 60, so as to cool the fluid. The second-side refrigerant heat-exchanged with the second fluid allowed to flow by the second fluid flow apparatus 60 has an elevated temperature so as to ideally become the second-side refrigerant in the form of gas. Then, the second-side refrigerant flows out from the second-side evaporator 44 so as to be again compressed by the second-side compressor 41.

The second-side refrigerant used in the second-side refrigeration circuit 45 in the second refrigerator unit 40 is not particularly limited, but is selected such that its boiling point is higher than a boiling point of the low-temperature-side refrigerant used in the low-temperature-side refrigerator 300 of the first refrigerator unit 10. In addition, upon selection of the second-side refrigerant, a target cooling temperature for the temperature control object is taken into consideration. In this embodiment, since the second fluid allowed to flow by the second fluid flow apparatus 60 is intended to be cooled down to −10° C., R410A is used as the second-side refrigerant. However, the type of the second-side refrigerant is not particularly limited. A boiling point of R410A is about −52° C., and a boiling point of R23 is about −82° C.

Third Refrigerator Unit

The third refrigerator unit 50 has a third-side refrigeration circuit 55 in which a third-side compressor 51, a third-side condenser 52, and a third-side expansion valve 53 and a third-side evaporator 54 are connected such that a third-side refrigerant circulates therethrough in this order. The third refrigerator unit 50 is configured to cool the third fluid allowed to flow by the third fluid flow apparatus 70 by means of the third-side evaporator 54.

In the third-side refrigeration circuit 55, the third-side compressor 51 compresses the third-side refrigerant basically in the form of gas, which flows out from the third-side evaporator 54, and supplies the third-side condenser 52 with the third-side refrigerant having an elevated temperature and an elevated pressure. The third-side condenser 52 cools and condenses, by means of the cooling water, the third-side refrigerant compressed by the third-side compressor 51, and supplies the third-side condenser 52 with the third-side refrigerant in the form of liquid, which has a predetermined temperature and a high pressure. Here, the third-side condenser 52 is connected to the third cooling pipe 2D of the cooling water flow apparatus 2 so as to cool the third-side refrigerant by means of the cooling water flowing out from the third cooling pipe 2D.

The third-side expansion valve 53 expands and decompresses the third-side refrigerant supplied from the third-side condenser 52, and supplies the third-side evaporator 54 with the third-side refrigerant in the form of gas-liquid or liquid, which has a lowered temperature and a lowered pressure as compared with the third-side refrigerant before being expanded. The third-side evaporator heat-exchanges the third-side refrigerant supplied thereto with the third fluid allowed to flow by the third fluid flow apparatus 70, so as to cool the fluid. The third-side refrigerant heat-exchanged with the third fluid allowed to flow by the third fluid flow apparatus 70 has an elevated temperature so as to ideally become the third-side refrigerant in the form of gas. Then, the third-side refrigerant flows out from the third-side evaporator 54 so as to be again compressed by the third-side compressor 51.

The third-side refrigerant used in the above third refrigerator unit 50 is not particularly limited, and is suitably determined in accordance with a target cooling temperature for the temperature control object. In this embodiment, R410A is used as the third-side refrigerant. However, the type of the third-side refrigerant is not particularly limited.

First Fluid Flow Apparatus

Next, the first fluid flow apparatus 20 has a first side fluid channel 21 through which the first fluid flows, and a first side pump 22 that gives a driving force for allowing the first fluid to flow through the first side fluid channel 21. In the first side fluid channel 21 in this embodiment, an intermediate part between an upstream port U and a downstream port D is connected to the medium-temperature-side first evaporator 204 of the medium-temperature-side refrigerator 200 and is connected to the low-temperature-side evaporator 304 of the low-temperature-side refrigerator 300. Further, the upstream port 21U and the downstream port 21D are connected to the valve unit 80.

The first fluid flowing out from the first side pump 22 is cooled by the medium-temperature-side refrigerant in the medium-temperature-side first evaporator 204, and is then cooled by the low-temperature-side refrigerant in the low-temperature-side evaporator 304. Thereafter, the first fluid flows into the valve unit 80. The valve unit 80 is configured to switch a state in which the first fluid received therein is supplied to the temperature control object Ta and is returned to the first side fluid channel 21, and a state in which the first fluid is retuned to the first side fluid channel 21 without being supplied to the temperature control object Ta. The first fluid allowed to flow by the first fluid flow apparatus 20 is not particularly limited, and a brine for ultralow temperature is used in this embodiment.

Second Fluid Flow Apparatus

The second fluid flow apparatus 60 has a second-side fluid channel 61 through which the second fluid flows, and a second-side pump 62 that gives a driving force for allowing the second fluid to flow through the second-side fluid channel 62. In the second-side fluid channel 61 in this embodiment, an intermediate part between an upstream port 61U and a downstream port 61D is connected to the second-side evaporator 44 of the second-side fluid channel 61. Further, the upstream port 61U and the downstream port 61D are connected to the valve unit 80.

The second fluid flowing out from the second-side pump 62 is cooled by the second-side refrigerant in the second-side evaporator 44, and then flows into the valve unit 80. The valve unit 80 is configured to switch a state in which the second fluid received therein is supplied to the temperature control object Ta and is returned to the second-side fluid channel 61, and a state in which the second fluid is retuned to the second-side fluid channel 61 without being supplied to the temperature control object Ta. The second fluid allowed to flow by the second fluid flow apparatus 60 is not particularly limited, and the same brine for ultralow temperature as that for the first fluid allowed to flow by the first fluid flow apparatus 20 is used in this embodiment. However, as long as no trouble occurs when the brine is mixed with the brine used for the first fluid, a brine used as the second fluid may be different from the brine forming the first fluid.

Third Fluid Flow Apparatus

The third fluid flow apparatus 70 has a third-side fluid channel 71 through which the third fluid flows, and a third-side pump 72 that gives a driving force for allowing the third fluid to flow through the third-side fluid channel 72.

The third-side fluid channel 71 is connected, at its intermediate part, to the third-side evaporator 54 of the third refrigerator unit 50. A downstream end of the third-side fluid channel 71 is connected to the temperature control object Ta, and an upstream end thereof is connected to the temperature control object Ta.

The third fluid flowing out from the third-side pump 72 is cooled by the third-side refrigerant in the third-side evaporator 54, and then flows into the temperature control object Ta. Thereafter, the third fluid returns to the third-side fluid channel 71. The third fluid allowed to flow by the third fluid flow apparatus 70 is not particularly limited, and a brine capable of flowing within a range of from 150° C. to 10° C. without any problem is used in this embodiment, instead of a brine for ultralow temperature.

Valve Unit

Figure 4:
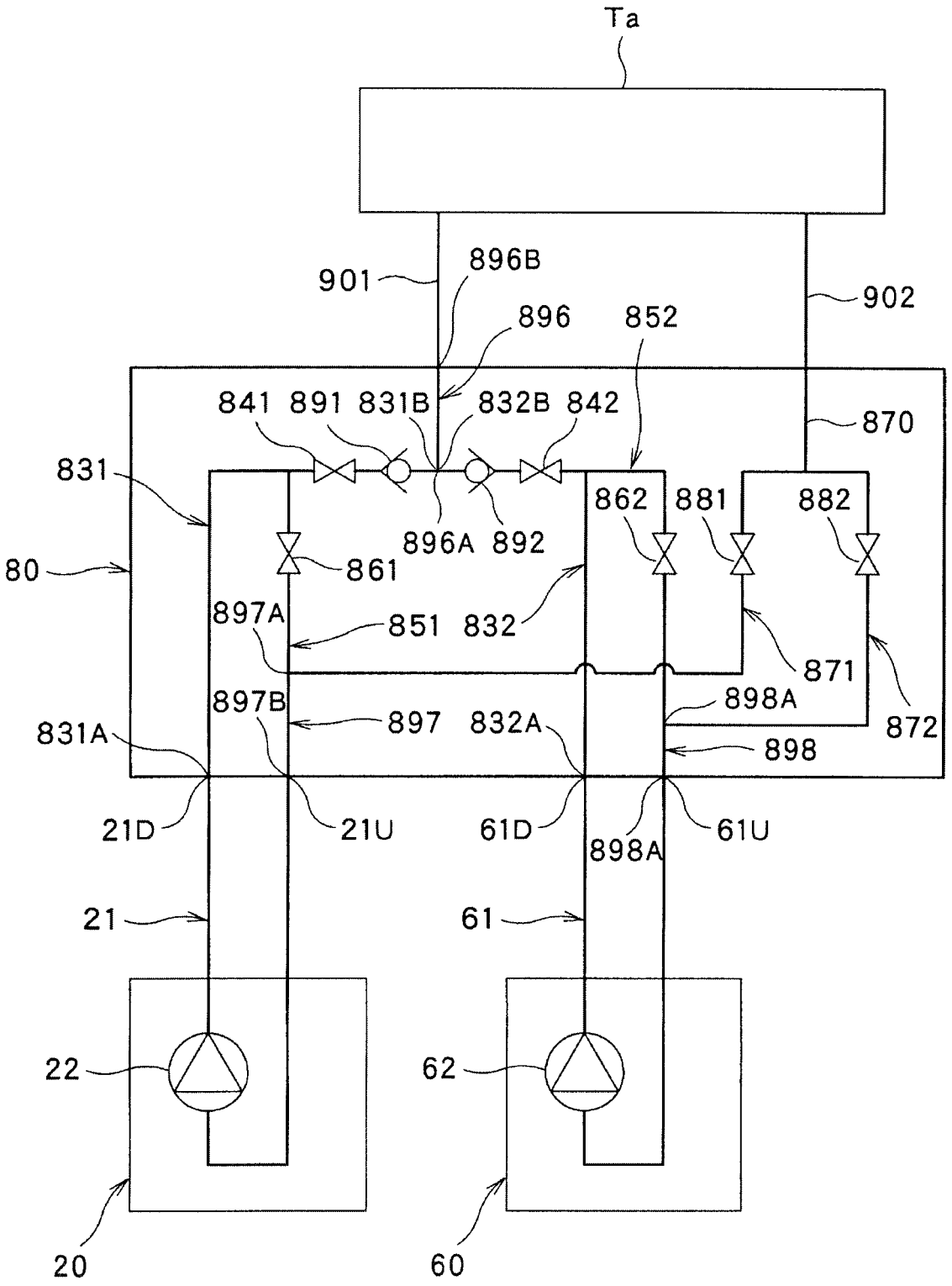
FIG. 4 is a schematic view of a valve unit that constitutes the temperature control system of FIG. 1.

Next, the valve unit 80 is described with reference to FIG. 4. FIG. 4 also schematically shows the first fluid flow apparatus 20 and the second fluid flow apparatus 60.

The valve unit 80 is fluidically connected to the upstream port 21U and the downstream port 21D of the first side fluid channel 21 of the first fluid flow apparatus 20, and is fluidically connected to the upstream port 61U and the downstream port 61D of the second-side fluid channel 61 of the second fluid flow apparatus 60, so as to be supplied with the first fluid from the downstream port 21D of the first side fluid channel 21, and supplied with the second fluid from the downstream port 61D of the second-side fluid channel 61. The valve unit 80 is configured to switch a state in which the first fluid is allowed to flow out therefrom to the temperature control object Ta and is then returned to the upstream port 21U and the second fluid is returned to the upstream port 61U without allowing it to flow out therefrom to the temperature control object Ta, and a state in which the first fluid is returned to the upstream port 21U without allowing it to flow out therefrom to the temperature control object Ta and the second fluid is allowed to flow out therefrom to the temperature control object Ta and is then retuned to the upstream port 61U.

The valve unit 80 and the temperature control object Ta are fluidically connected to the valve unit 80 through a supply-side relay channel 901 and a return-side relay channel 902. When the valve unit 80 supplies the first fluid or the second fluid to the temperature control object Ta, the first fluid or the second fluid having passed through the temperature control object Ta returns to the valve unit 80 through the return-side relay channel 902. On the other hand, when the first fluid or the second fluid is not supplied to the temperature control object Ta, the first fluid or the second fluid is turned around in the valve unit 80 and is retuned to the first side fluid channel 21 or the second-side fluid channel 61.

The valve unit 80 comprises a first supply channel 831, a first supply-side solenoid switching valve 841, a first branch channel 851, a first branch-side solenoid switching valve 861, a second supply channel 832, a second supply-side solenoid switching valve 842, a second branch channel 852, a second branch-side solenoid switching valve 862, a reception channel 870, a first circulation channel 871, a second circulation channel 872, a first circulation-side solenoid switching valve 881 and a second circulation-side solenoid switching valve 882. In this specification, the term "switching valve" means a switching two-way valve.

The first supply channel 831 has a first inlet port 831A and a first outlet port 831B, and is configured to allow the first fluid flowing into the first inlet port 831A to flow therethrough and to flow out from the first outlet port 831B. In this embodiment, the downstream port 21D of the first side fluid channel 21 is directly connected to the first inlet port 831A. Thus, the first inlet port 831A is opened outside, before the first side flow channel 21 is connected thereto.

The first supply-side solenoid switching valve 841 is provided on the first supply channel 831, and is configured to be switched between an opened state and a closed state, so as to switch flow and shut-off of the first fluid in the first supply channel 831. The first supply-side solenoid switching valve 841 has a solenoid. By applying and not applying current to the solenoid for excitation and non-excitation, the opened state and the closed state are switched.

In addition, the first supply channel 831 is provided with a first check valve 891 located on the downstream side of the first supply-side solenoid switching valve 841. The first check valve 891 is configured to prevent the first fluid from flowing from the first outlet port 831B toward the first supply-side solenoid switching valve 841.

The first branch channel 851 is branched from a part of the first supply channel 831, which part is on the upstream side of the first supply-side solenoid switching valve 841, and is configured to allow the first fluid flowing from the first supply channel 831 to flow therethrough.

The first branch-side solenoid switching valve 861 is provided on the first branch channel 851, and is configured to be switched between an opened state and a closed state, so as to switch flow and shut-off of the first fluid in the first branch channel 851. The first branch-side solenoid switching valve 861 has a solenoid. By applying and not applying current to the solenoid for excitation and non-excitation, the opened state and the closed state are switched.

The second supply channel 832 has a second inlet port 832A and a second outlet port 832B, and is configured to allow the second fluid flowing into the second inlet port 832A to flow therethrough and to flow out from the second outlet 832B. In this embodiment, the downstream port 61D of the second-side fluid channel 61 is directly connected to the second inlet port 832A. Thus, the second inlet port 832A is opened outside, before the second-side flow channel 61 is connected thereto.

The second supply-side solenoid switching valve 842 is provided on the second supply channel 832, and is configured to be switched between an opened state and a closed state, so as to switch flow and shut-off of the second fluid in the second supply channel 832. The second supply-side solenoid switching valve 842 has a solenoid. By applying and not applying current to the solenoid for excitation and non-excitation, the opened state and the closed state are switched.

In addition, the second supply channel 832 is provided with a second check valve 892 located on the downstream side of the second supply-side solenoid switching valve 842. The second check valve 892 is configured to prevent the second fluid flowing from the second outlet port 832B toward the second supply-side solenoid switching valve 842.

Here, the valve unit 80 in this embodiment further comprises a supply-side common channel 896 that has a connection port 896A connecting to the first outlet port 831B of the first supply channel 831 and to the second outlet port 832B of the second supply channel 832, and an end port 896B directly connected to the supply-side relay channel 901.

The end port 896B of the supply-side common channel 896 is opened outside, before the supply-side relay channel 901 is connected thereto. In this embodiment, since the supply-side common channel 896 is provided, the first fluid from the first side fluid channel 21 or the second fluid from the second-side fluid channel 61 is supplied to the supply-side relay channel 901 from the end port 896B of the supply-side common channel 896, which is a common exit.

The second branch channel 852 is branched from a part of the second supply channel 832, which part is on the upstream side of the second supply-side solenoid switching valve 842, and is configured to allow the second fluid flowing from the second supply channel 832 to flow therethrough.

The second branch-side solenoid switching valve 862 is provided on the second branch channel 852, and is configured to be switched between an opened state and a closed state, so as to switch flow and shut-off of the second fluid in the second branch channel 852. The second branch-side solenoid switching valve 862 has a solenoid. By applying and not applying current to the solenoid for excitation and non-excitation, the opened state and the closed state are switched.

The reception channel 870 is configured to receive, through the return-side relay channel 902, the first fluid, which flows out from the first outlet port 831B to flow through the temperature control object Ta and then returns toward the valve unit 80, or the second fluid, which flows out from the second outlet port 832B to flow through the temperature control object Ta and then returns toward the valve unit 80. An upstream port of the reception channel 870 is directly connected to the return-side relay channel 902, and is opened outside before the return-side relay channel 902 is connected thereto.

The first circulation channel 871 and the second circulation channel 872 are biforked from a downstream port of the reception channel 870. The first circulation channel 871 and the second circulation channel 872 can allow the fluid flowing out from the downstream port of the reception channel 870 to flow therethrough.

The first circulation-side solenoid switching valve 881 is provided on the first circulation channel 871, and is configured to switch an opened state and a closed state of the first circulation channel 871. The first circulation-side solenoid switching valve 881 has a solenoid. By applying and not applying current to the solenoid for excitation and non-excitation, the opened state and the closed state are switched.

The second circulation-side solenoid switching valve 882 is provided on the second circulation channel 872, and is configured to switch an opened state and a closed state of the second circulation channel 872. The second circulation-side solenoid switching valve 882 has a solenoid. By applying and not applying current to the solenoid for excitation and non-excitation, the opened state and the closed state are switched.

Here, the valve unit 80 in this embodiment further comprises a first discharge-side common channel 897 that has a connection port 897A connecting to the downstream port of the first branch channel 851 and to the downstream port of the first circulation channel 871, and an end port 897B directly connected to the upstream port 21U of the first side fluid channel 21. In addition, the valve unit 80 further comprises a second discharge-side common channel 898 that has a connection port 898A connecting to the downstream port of the second branch channel 852 and to the downstream port of the second circulation channel 872, and an end port 898B directly connected to the upstream port 61U of the second-side fluid channel 61.

The end port 897B of the first discharge-side common channel 897 is opened outside, before the first side fluid channel 21 is connected thereto. The end port 898B of the second discharge-side common channel 898 is opened outside, before the second fluid channel 61 is connected thereto.

In addition, in the aforementioned valve unit 80, the first supply-side solenoid switching valve 841, the second supply-side solenoid switching valve 842, the first branch-side solenoid switching valve 861, the second branch-side solenoid switching valve 862, the first circulation-side solenoid switching valve 881 and the second circulation-side solenoid switching valve 882 are respectively formed of pilot-type solenoid switching valves, more specifically, pilot kick-type solenoid switching valves of the same size and of the same structure.

Figure 7:
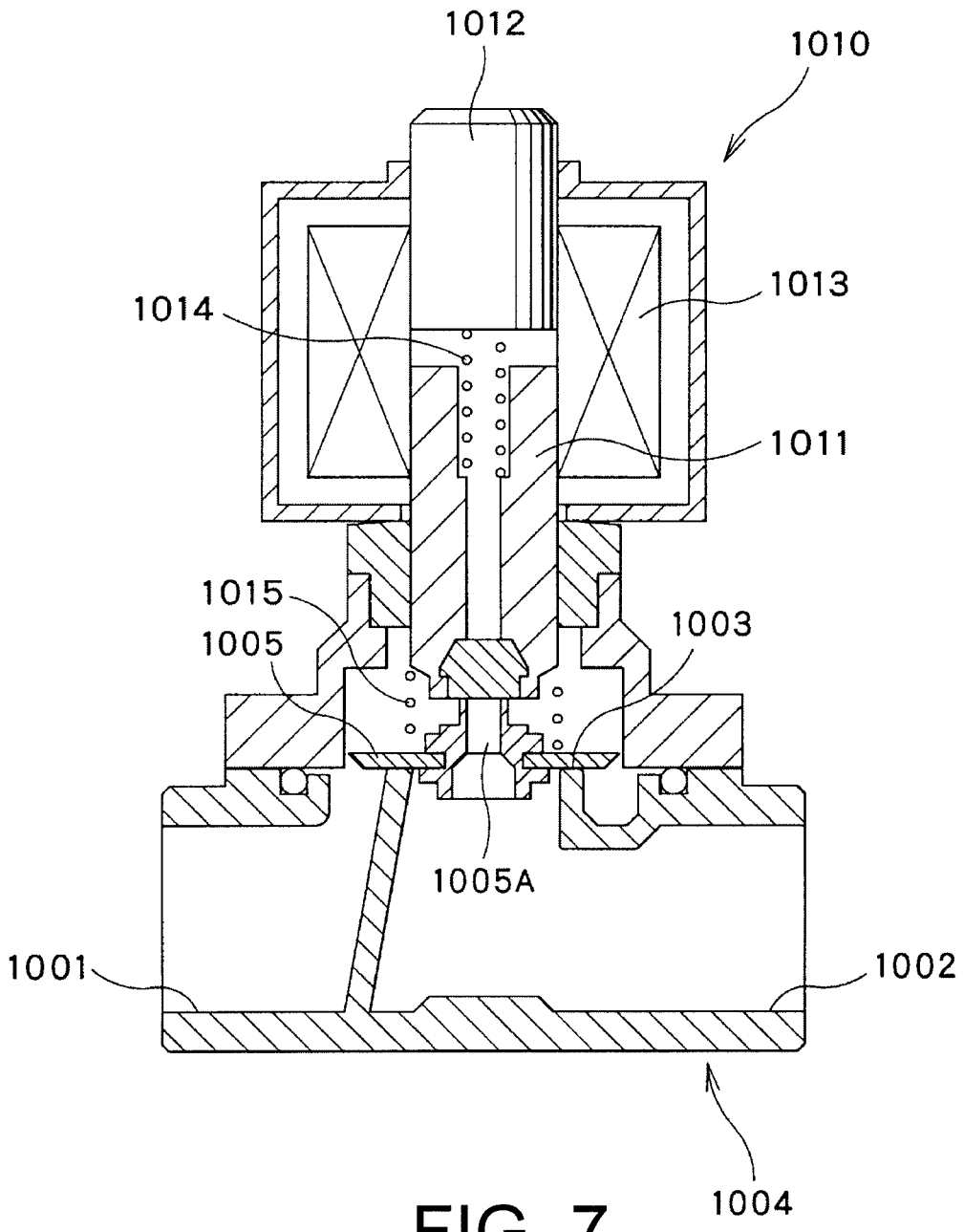
FIG. 7 is a sectional view of a pilot kick-type solenoid valve that can be used as a valve provided on the valve unit of FIG. 4.

FIG. 7 is a sectional view of a pilot kick-type solenoid switching valve that can be used as the each aforementioned valve in the valve unit 80. The pilot kick-type solenoid switching valve shown in FIG. 7 comprises a valve body 1004 having an inlet 1001, an outlet 1002, and a valve seat 1003 formed between the inlet 1001 and the outlet 1002; a valve element 1005 that can be positioned in contact with or away from the valve seat 1003; and a solenoid drive unit 1010 that brings the valve element 1005 into contact with or away from the valve seat 1003.

The solenoid drive unit 1010 comprises a shaft-like movable iron core 1011, a shaft-like fixed iron core 1012 lined coaxially with the movable iron core 1011, a coil 1013 disposed around the movable iron core 1011 and the fixed iron core 1012, a first spring 1014 provided between the movable iron core 1011 and the fixed iron core 1012 for giving an elastic force to the movable iron core 1011 toward the valve seat 1003, and a second spring 1015 connecting the movable iron core 1011 to the valve element 1005 for giving an elastic force to the valve element 1005 in contact with the valve seat 1003 toward the movable iron core 1011. An opening 1005A is formed in the valve element 1005. When the coil 1013 is in the non-excitation state, the movable iron core 1011 closes, with its distal end, the opening 1005A by means of the elastic force of the first spring 1014. When the coil 1013 is supplied with current so as to become the excitation state, the movable iron core 1011 is moved toward the fixed iron core 1012, so that the opening 1005A is opened.

When such a pilot kick-type solenoid switching valve is changed from the closed state to the opened state, the coil 1013 is supplied with current so as to become the excitation state. At this time, a fluid firstly flows from the opening 1005A to the downstream side. Thereafter, as the fluid flows to the downstream side, the valve element 1005 moves away from the valve seat 1003, so that the fluid flows from the valve seat 1003 to the downstream side. Since the pilot kick-type solenoid valve can ensure a large caliber (channel area) due to its stepwise opening motion, it is suited for the switching of fluid at a high flowrate such as 20 L/min or more, for example.

As long as a fluid can be allowed to flow to the downstream side at a high flowrate without decreasing a flow velocity, the first supply-side solenoid switching valve 841, the second supply-side solenoid switching valve 842, the first branch-side solenoid switching valve 861, the second branch-side solenoid switching valve 862, the first circulation-side solenoid switching valve 881 and the second circulation-side solenoid switching valve 882 may be formed of direct acting solenoid switching valves. When a flowrate is not high, a direct acting solenoid switching valve is preferred in consideration of cost. In addition, a pilot-type solenoid switching valve may be employed instead of a pilot kick-type solenoid switching valve.

In addition, in this embodiment, the first supply-side solenoid switching valve 841, the second supply-side solenoid switching valve 842, the first branch-side solenoid switching valve 861, the second branch-side solenoid switching valve 862, the first circulation-side solenoid switching valve 881 and the second circulation-side solenoid switching valve 882 are pilot kick-type solenoid switching valves. However, for example, only the first supply-side solenoid switching valve 841 and the second supply-side solenoid switching valve 842 may be pilot kick-type solenoid switching valves, while others may be direct acting solenoid switching valves.

In addition, in this embodiment, since a temperature of the first fluid is controlled down to −70° C. or less, it is preferable to use, for the respective solenoid valves, a material that can be sufficiently tolerable to a low temperature. To be specific, the valve body and the valve element are preferably made of PTFE (polytetra fluoroethylene). The valve body may be made of brass. The movable iron core, the fixed iron, the spring and so on may be made of stainless steel.

Operation

Next, an example of an operation of the temperature control system 1 is described.

In order to operate the temperature control system 1, based on a command of the control device 90, the high-temperature-side compressor 101 of the high-temperature-side refrigerator 100, the medium-temperature-side compressor 201 of the medium-temperature-side refrigerator 200, and the low-temperature-side compressor 301 of the low-temperature-side refrigerator 300 in the first refrigerator unit 10 are driven, the second-side compressor 41 of the second refrigerator unit 40 is driven, and the third-side compressor 51 of the third refrigerator unit 50 is driven. In addition, based on the command of the control device 90, the first side pump 22 of the first fluid flow apparatus 20, the second-side pump 62 of the second fluid flow apparatus 60, and the third-side pump 72 of the third fluid flow apparatus 70 are driven.

Thus, the high-temperature-side refrigerant is circulated in the high-temperature-side refrigerator 100, the medium-temperature-side refrigerant is circulated in the medium-temperature-side refrigerator 200, and the low-temperature-side refrigerant is circulated in the low-temperature-side refrigerator 300. The second-side refrigerant is circulated in the second refrigerator unit 40, and the third-side refrigerant is circulated in the third refrigerator unit 50. In addition, the first fluid flows through the first fluid flow apparatus 20, the second fluid flows through the second fluid flow apparatus 60, and the third fluid flows through the third fluid flow apparatus 70.

During the cooling operation, the control device 90 can suitably regulate opening degrees of the high-temperature-side expansion valve 103, the flowrate regulation valve 122 and the cooling expansion valve 132 in the high-temperature-side refrigerator 100, the medium-temperature-side first expansion valve 203, medium-temperature-side second expansion valve 223, the flowrate regulation valve 232 and the medium-temperature-side third expansion valve 243 in the medium-temperature-side refrigerator 200, and the low-temperature-side expansion valve 303 and the flowrate regulation valve 322 of the low-temperature-side refrigerator 300. Similarly, the opening degrees of the second-side expansion valve 43 and the third-side expansion valve 53 can be regulated. In this embodiment, the above-described respective valves are electronic expansion valves whose opening degree can be regulated based on an external signal.

In the high-temperature-side refrigerator 100 of the first refrigerator unit 10, the high-temperature-side refrigerant compressed by the high-temperature-side compressor 101 is condensed by the high-temperature-side condenser 102, and is then supplied to the high-temperature-side expansion valve 103. The high-temperature-side expansion valve 103 expands the high-temperature-side refrigerant condensed by the high-temperature-side condenser 102 to lower its temperature, and supplies the high-temperature-side refrigerant to the high-temperature-side evaporator 104. As described above, the high-temperature-side evaporator 104 constitutes the first cascade condenser CC1 together with the medium-temperature-side condenser 202 of the medium-temperature-side refrigerator 200, and heat-exchanges the high-temperature-side refrigerant supplied thereto with the medium-temperature-side refrigerant circulated by the medium-temperature-side refrigerator 200, so as to cool the medium-temperature-side refrigerant.

Figure 2:
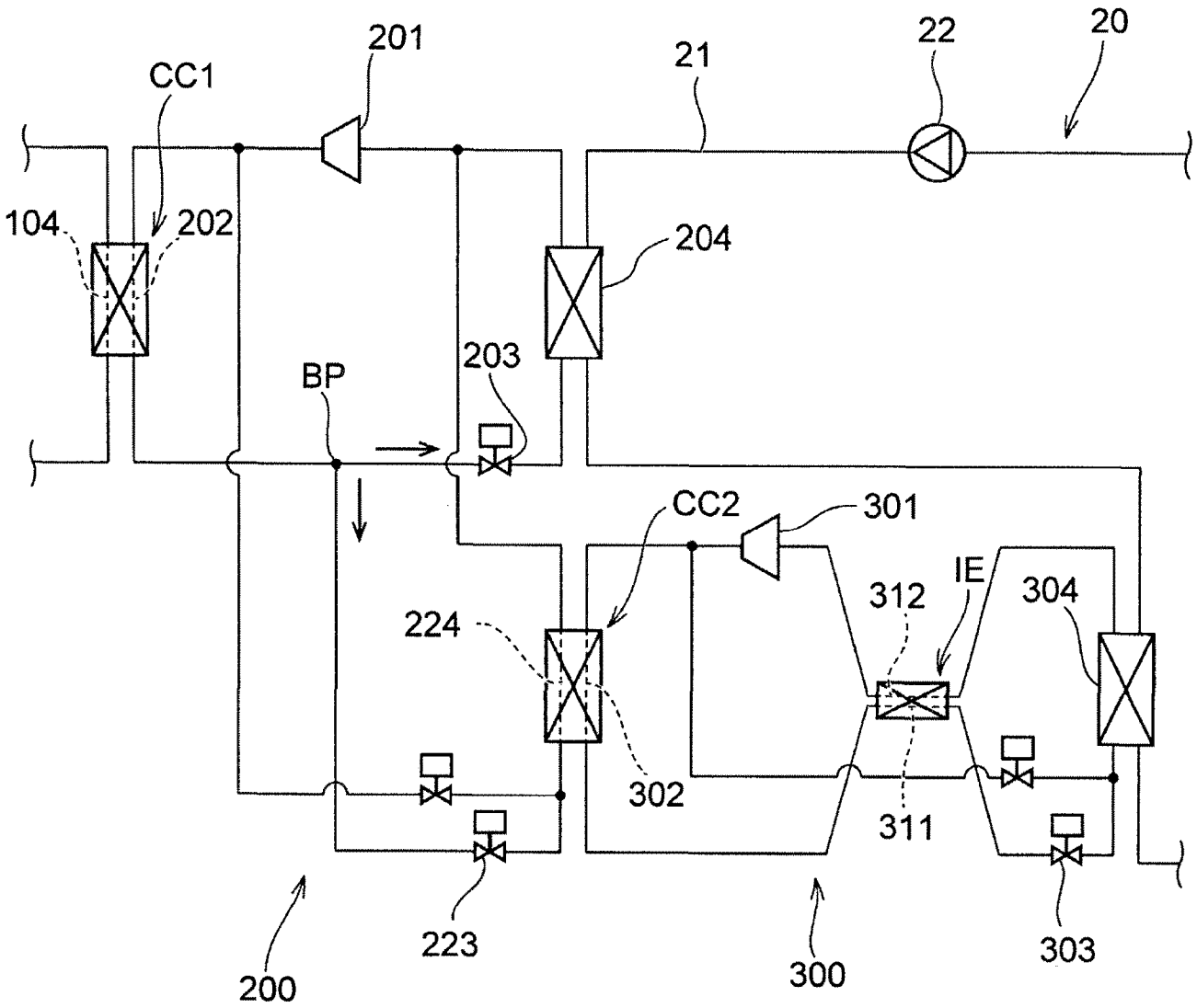
FIG. 2 is an enlarged view of a medium-temperature-side refrigerator and a low-temperature-side refrigerator that constitute the temperature control system of FIG. 1.

In the medium-temperature-side refrigerator 200, the medium-temperature-side refrigerant compressed by the medium-temperature-side compressor 201 is condensed in the first cascade condenser CC1, and is branched at a branch point BP shown in FIG. 2, so as to be sent to the medium-temperature-side first expansion valve 203 and the medium-temperature-side expansion valve 223, as shown by the arrow. When the first fluid is cooled down to an extremely low temperature, the medium-temperature-side first expansion valve 203 and the medium-temperature-side second expansion valve 223 are both opened. The medium-temperature-side first expansion valve 203 expands the medium-temperature-side refrigerant condensed by the first cascade condenser CC1 to lower its temperature, and supplies the medium-temperature-side refrigerant to the medium-temperature-side first evaporator 204. On the other hand, the medium-temperature-side second expansion valve 223 expands the medium-temperature-side refrigerant condensed by the first cascade condenser CC1 to lower its temperature, and supplies the medium-temperature-side refrigerant to the medium-temperature-side second evaporator 224.

Then, the medium-temperature-side first evaporator 204 cools the first fluid allowed to flow by the first fluid allowed to flow by the first fluid flow apparatus 20 by means of the medium-temperature-side refrigerant. As described above, the medium-temperature-side second evaporator 224 constitutes the second cascade condenser CC2 together with the low-temperature-side condenser 302 of the low-temperature-side refrigerator 300, and heat-exchanges medium-temperature-side refrigerant supplied thereto with the low-temperature-side refrigerant circulated by the low-temperature-side refrigerator 300 so as to cool the low-temperature-side refrigerant.

Figure 3:
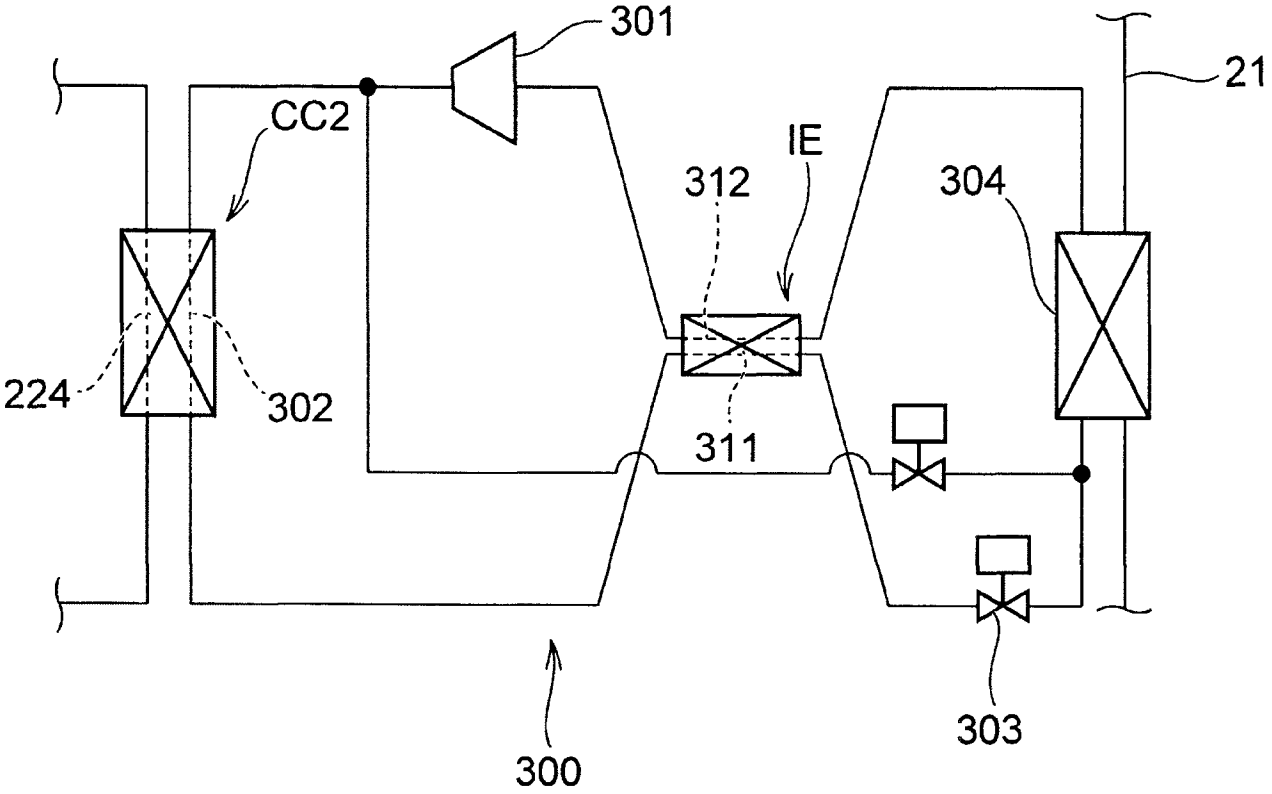
FIG. 3 is an enlarged view of the low-temperature-side refrigerator that constitutes the temperature control system of FIG. 1.

In the low-temperature-side refrigerator 300, the low-temperature-side refrigerant compressed by the low-temperature-side compressor 301 is condensed by the second cascade condenser CC2, and is sent to the low-temperature-side expansion valve 303 through the internal heat exchanger IE, as shown in FIG. 3. The low-temperature-side expansion valve 303 expands the low-temperature-side refrigerant passing through internal heat exchanger IE to lower its temperature, and supplies the low-temperature-side refrigerant to the low-temperature-side evaporator 304. The low-temperature-side evaporator 304 cools the first fluid allowed to flow by the first fluid flow apparatus 20 by means of the low-temperature-side refrigerant. The first fluid, which has been cooled by the medium-temperature-side first evaporator 204 and then cooled by the low-temperature-side evaporator 304, flows into the valve unit 80.

In addition, in the internal heat exchanger IE, the low-temperature-side refrigerant that has flown out from the low-temperature-side condenser 302 and is going to flow into the low-temperature-side expansion valve 303, and the low-temperature-side refrigerant that has flown out from the low-temperature-side evaporator 304 and is going to flow into the low-temperature-side compressor 301, are heat-exchanged with each other. Thus, a degree of supercooling is given to the low-temperature-side refrigerant having flown out from the low-temperature-side condenser 302.

In the second refrigeration circuit 45 of the second refrigerator unit 40, the second-side refrigerant compressed by the second-side compressor 41 is condensed by the second-side condenser 42, and is supplied to the second-side expansion valve 43. The second-side expansion valve 43 expands the second-side refrigerant condensed by the second-side condenser 42 to lower its temperature, and supplies the second-side refrigerant to the second-side evaporator 44. The second-side evaporator 44 cools the second fluid allowed to flow by the second fluid flow apparatus 60 by means of the second-side refrigerant supplied thereto. The second fluid cooled by the second-side evaporator 44 flows into the valve unit 80.

In addition, in the third-side refrigeration circuit 55 of the third refrigerator unit 50, the third-side refrigerant compressed by the third-side compressor 51 is condensed by the third-side condenser 52, and is supplied to the third-side expansion valve 53. The third-side expansion valve 53 expands the third-side refrigerant condensed by the third-side condenser 52 to lower its temperature, and supplies the third-side refrigerant to the third-side evaporator 54. The third-side evaporator 54 cools the third fluid allowed to flow by the third fluid flow apparatus 70 by means of the third-side refrigerant supplied thereto. The third fluid cooled by the third-side evaporator 54 flows into the temperature control object Ta, and controls a temperature of the temperature control object Ta. After that, the third fluid returns to the third fluid flow apparatus 70.

On the other hand, the first fluid and the second fluid flowing into the valve unit 80 are selectively supplied to the temperature control object Ta. Opening and closing of the respective valves included in the valve unit 80 are controlled by control signals from the control device 90.

When the first fluid is supplied to the temperature control object Ta, the first supply-side solenoid switching valve 841 and the first circulation-side solenoid switching valve 881 are opened, and the first branch-side solenoid switching valve 861 is closed. In addition, the second supply-side solenoid switching valve 842 and the second circulation-side solenoid switching valve 882 are closed, and the second branch-side solenoid switching valve 862 is opened.

Figure 5:
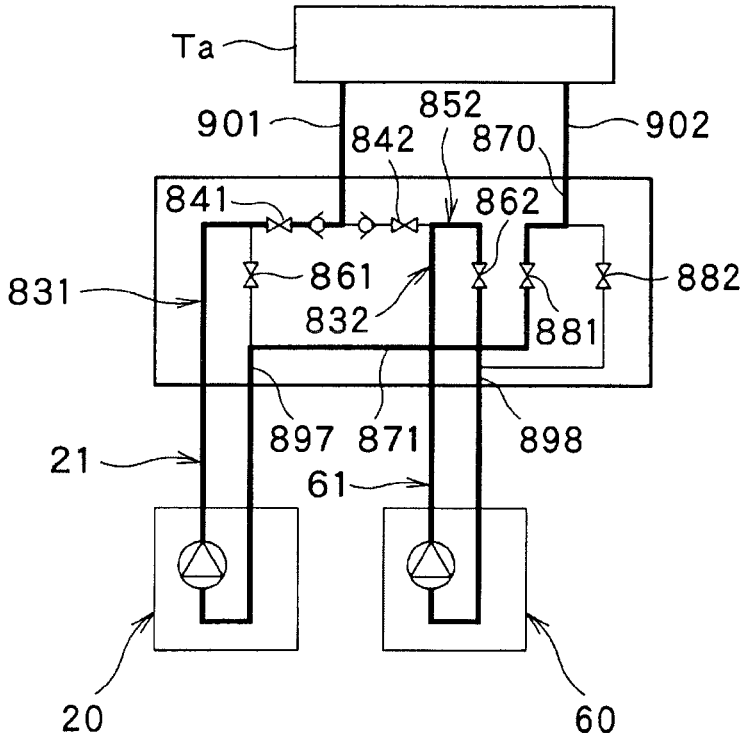
FIG. 5 is a view that explains an operation of the temperature control system of FIG. 1.

At this time, as shown in FIG. 5, the first fluid flowing out from the first side fluid channel 21 flows to the temperature control object Ta through the first supply channel 831. Then, the first fluid flowing out from the temperature control object Ta flows to the reception channel 870 through the return-side relay channel 902. Thereafter, the first fluid returns to the first side fluid channel 21 through the first circulation channel 871 and the second circulation channel 897. Meanwhile, the second fluid flowing out from the second-side fluid channel 61 is circulated in a closed circuit composed of the second-side fluid channel 61, a part of the second supply channel 832, the second branch channel 852 and the second discharge-side common channel 898.

On the other hand, when the second fluid is supplied to the temperature control object Ta, the second supply-side solenoid switching valve 842 and the second circulation-side solenoid switching valve 882 are closed, and the second branch-side solenoid switching valve 862 is closed. In addition, the first supply-side solenoid switching valve 841 and the first circulation-side solenoid switching valve 881 are closed, and the first branch-side solenoid switching valve 861 is opened.

Figure 6:
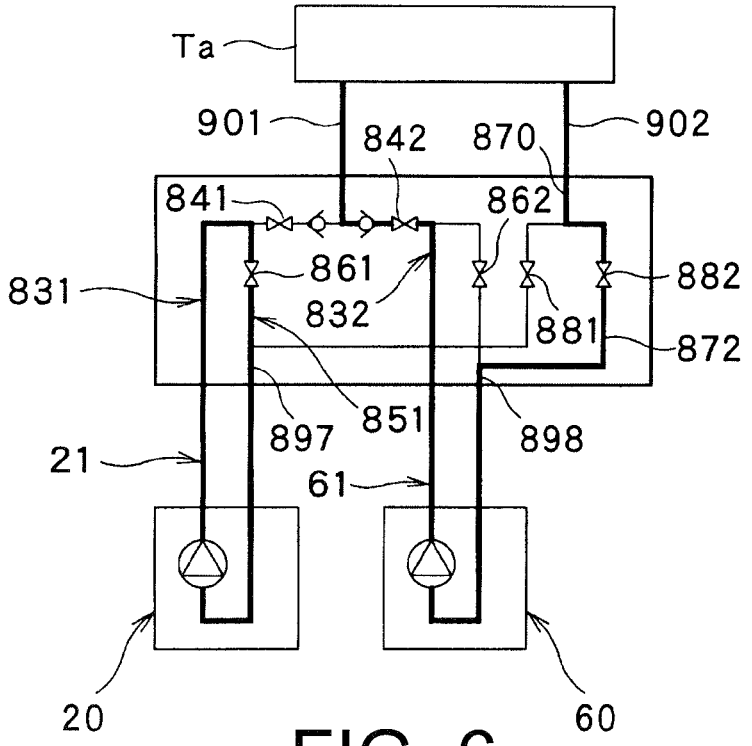
FIG. 6 is a view that explains the operation of the temperature control system of FIG. 1.

At this time, as shown in FIG. 6, the second fluid flowing out from the second-side fluid channel 61 flows to the temperature control object Ta through the second supply channel 832. Then, the second fluid flowing out from the temperature control object Ta flows to the reception channel 870 through the return-side relay channel 902. Thereafter, the second fluid returns to the second-side fluid channel 61 through the second circulation channel 872 and the second discharge-side common channel 898. Meanwhile, the first fluid flowing out from the first side fluid channel 21 is circulated in a closed circuit composed of the first side fluid channel 21, a part of the first supply channel 831, the first branch channel 851 and the first discharge-side common channel 897.

In the above-described temperature control system 1, the first fluid allowed to flow by the first fluid flow apparatus 20 is cooled (precooled) by the medium-temperature-side first evaporator 204 of the medium-temperature-side refrigerator 200, and is then cooled by the low-temperature-side evaporator 304 of the low-temperature-side refrigerator 300, which can output a refrigeration capacity larger than that of the medium-temperature-side first evaporator 204. Thus, in order to cool a temperature control object down to a target desired temperature, the temperature control system 1 can be more easily manufactured than a simple ternary refrigeration apparatus employing a high-performance compressor in the low-temperature-side refrigerator 300. To be specific, since the low-temperature-side compressor 301 of the low-temperature-side refrigerator 300 can be particularly simplified, cooling of a temperature control object down to a desired temperature set in an extremely low temperature region can be easily and stably realized.

In addition, the second fluid is thermally controlled by the second refrigerator unit 40 separate from the first refrigerator unit 10 such that the second fluid has a temperature lower than that of the first fluid. The first fluid and the second fluid controlled to have different temperatures are selectively switched by the valve unit 80 to flow out therefrom, whereby switching of temperature controls of large temperature difference within a temperature control range including a temperature region down to an extremely low temperature can be quickly performed.

Thus, the present invention can easily and stably realize cooling down to an extremely low temperature, and further can quickly perform switching of temperature controls of large temperature difference within a temperature control range including a temperature region down to an extremely low temperature.

In addition, in the internal heat exchanger IE, the low-temperature-side refrigerant that has flown out from the low-temperature-side condenser 302 and is going to flow into the low-temperature-side expansion valve 303, and the low-temperature-side refrigerant that has flown out from the low-temperature-side evaporator 304 and is going to flow into the low-temperature-side compressor 301, are heat-exchanged with each other. Thus, the low-temperature-side refrigerant having flown out from the low-temperature-side condenser 302 can be cooled before it flows into the low-temperature-side expansion valve 303, and the low-temperature-side refrigerant having flown out from the low-temperature-side evaporator 304 can be heated before it flows into the low-temperature-side compressor 301. As a result, the refrigeration capacity of the low-temperature-side evaporator 304 an be easily increased, as well as the burden for ensuring durability (cold tolerance) of the the low-temperature-side compressor can be lessened. Thus, since a desired cooling can be easily realized without excessively increasing the performance of the low-temperature-side compressor 301, manufacturing facility can be improved.

In addition, upon start-up, there is a problem in that a degree of superheat of the low-temperature-side refrigerant flowing out from the low-temperature-side evaporator 304 may increase. However, the degree of superheat of the low-temperature-side refrigerant can be reduced by the internal heat exchanger IE. In addition, in this embodiment, upon start-up, the temperature control object Ta is firstly cooled by the second fluid cooled by the second refrigerator unit 40. Following thereto, the first fluid flow apparatus 20 is actuated. By allowing the first fluid to pass through the cooled temperature control object Ta, the first fluid is cooled. Following thereto, the first refrigerator unit 10 is actuated, and the first fluid that has been cooled down to some extent is cooled by the medium-temperature-side first evaporator 204 and the low-temperature-side evaporator 304, whereby the degree of superheat problem can be solved.

In addition, in the valve unit 80, the state in which the first fluid is supplied to the temperature control object Ta is switched to the state in which the second fluid is supplied to the temperature control object Ta, and vice versa. At this time, since the valves for switching the fluid flows are solenoid switching valves (841, 842, 861, 862, 881, 882), the first fluid supply state and the second fluid supply state can be quickly switched by supplying and breaking current. In addition, since the valve for switching the fluid flows is a solenoid switching valve, a caliber of the valve seat can be increased as compared with a proportional solenoid valve. Thus, a liquid at a high flowrate can be properly opened/closed. In addition, as compared with a case in which a proportional solenoid calve is used, leakage of liquid can be suppressed. Thus, fluids (first fluid and second fluid) of different temperatures can be quickly switched and supplied, as well as temperature variation of a fluid to be supplied can be prevented. Namely, it is possible to prevent that a temperature of the second fluid is varied by the first fluid, or that a temperature of the first fluid is varied by the second fluid.

In addition, in this embodiment, when the first fluid is allowed to flow out from the first outlet port 831B, the first supply-side solenoid switching valve 841 and the first circulation-side solenoid switching valve 881 are opened, and the first branch-side solenoid switching valve 861 is closed. In addition, the second supply-side solenoid switching valve 842 and the second circulation-side solenoid switching valve 882 are closed, and the second branch-side solenoid switching valve 862 is opened. On the other hand, when the second fluid is allowed to flow out from the second outlet port 832B, the second supply-side solenoid switching valve 842 and the second circulation-side solenoid switching valve 882 are opened, and the second branch-side solenoid switching valve 862 is closed. In addition, the first supply-side solenoid switching valve 841 and the first circulation-side solenoid switching valve 881 are closed, and the first branch-side solenoid switching valve 861 is opened.

As described above, in this embodiment, the state of the respective solenoid switching valves when the first fluid is allowed to flow out from the first outlet port 831B, and the state of the respective solenoid switching valves when the second fluid is allowed to flow out from the second outlet port 832B, can be switched by inverting the control signals for the respective valves. Thus, fluids of different temperatures can be extremely quickly and easily switched and supplied.

In addition, the first supply channel 831 is provided with the first check valve 891 located on the downstream side of the first supply-side solenoid switching valve 841, and the second supply channel 832 is provided with the second check valve 892 located on the downstream side of the second supply-side solenoid switching valve 842. Thus, when the first fluid is allowed to flow out from the first outlet port 831B, the first fluid is prevented from flowing toward the second-side fluid channel 61, and when the second fluid is allowed to flow out from the second outlet port 832B, the second fluid is prevented from flowing toward the first side fluid channel 21. Thus, since undesired leakage and temperature variation of the first fluid or the second fluid can be prevented, efficient fluid supply is enabled.

Note that the present invention is not limited to the aforementioned embodiment, and that the aforementioned embodiment can be variously modified.

Modification Example of Valve Unit

A modification example of the valve unit 80 is described herebelow. A constituent element of the modification example, which is the same as that of the above embodiment, has the same reference number, and its description may be omitted.

Figure 8:
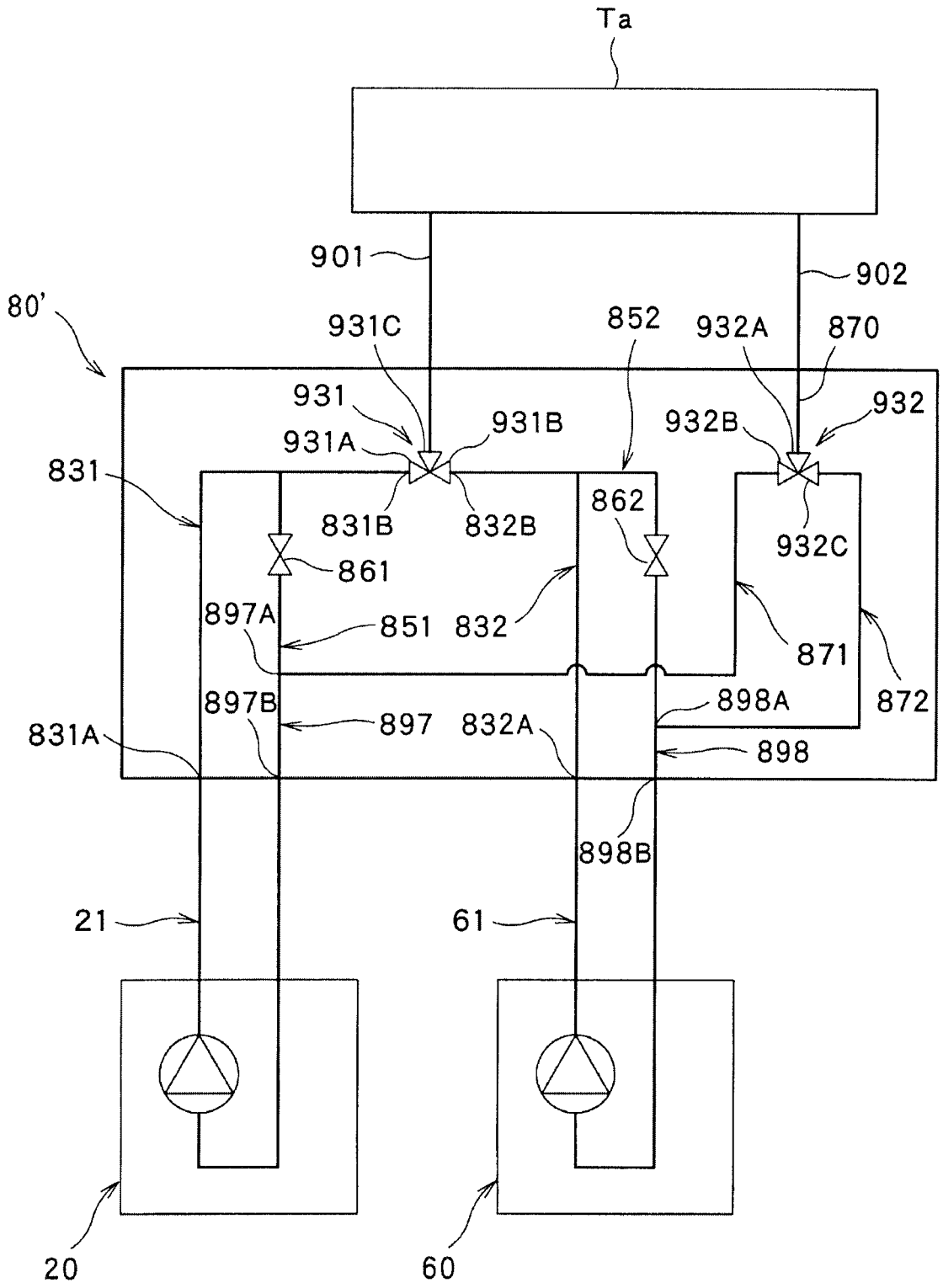
FIG. 8 is a schematic view showing a modification example of the valve unit.

A valve unit 80' according to the modification example shown in FIG. 8 comprises a first supply channel 831, a second supply channel 832, a supply-side channel switching three-way valve 931, a first branch channel 851, a first branch-side solenoid switching valve 861, a second branch channel 852, a second branch-side solenoid switching valve 862, a circulation-side channel switching three-way valve 932, a first circulation channel 871, and a second circulation channel 872.

The first supply channel 831 has a first inlet port 831A and a first outlet port 831B, and is configured to allow the first fluid flowing into the first inlet port 831A to flow therethrough and to flow out from the first outlet port 831B.

The second supply channel 832 has a second inlet port 832A and a second outlet port 832B, and is configured to allow the second fluid flowing into the second inlet port 832A to flow therethrough and to flow out from the second outlet port 832B.

The supply-side channel switching three-way valve 931 has a first fluid inlet 931A connected to the first inlet port 831B to receive the first fluid, a second fluid inlet 931B connected to the second outlet port 832B to receive the second fluid, and a supply-side outlet port 931C, and is configured to switch fluid connection between the first fluid inlet 931A and the supply-side outlet 931C, and fluid connection between the second fluid inlet 931B and the supply-side outlet 931C.

The first branch channel 851 branches from the first supply channel 831, and allows the first fluid flowing from the first supply channel 831 to flow therethrough. The first branch-side solenoid switching valve 861 is provided on the first branch channel 851, and is configured to be switched between an opened state and a closed state so as to switch flow and shut-off of the first fluid in the first branch channel 851.

The second branch channel 852 branches from the second supply channel 832, and allows the second fluid flowing from the second supply channel 832 to flow therethrough. The second branch-side solenoid switching valve 862 is provided on the second branch channel 852, and is configured to be switched between an opened state and a closed state so as to switch flow and shut-off of the second fluid in the second branch channel 852.

The circulation-side channel switching three-way valve 932 has a circulation-side inlet 932A that receives the first fluid or the second fluid which flows out from the supply-side outlet 931C and then returns to the valve unit 80' via the temperature control object Ta, a first outlet 932B and a second outlet 932C, and is configured to switch fluid connection between the circulation-side inlet 932A and the first outlet 932B, and fluid connection between the circulation-side inlet 932A and the second outlet 932C.

The circulation-side inlet 932A is connected to the reception channel 870. The first circulation channel 871 is connected to the first outlet 932B, and the second circulation channel 872 is connected to the second outlet 932C. Here, the valve unit 80' in this embodiment also further comprises a first discharge-side common channel 897 having a connection port 897A connected to a downstream port of the first branch channel 851 and a downstream port of the first circulation channel 871, and an end port 897B directly connected to the first-side fluid channel 21. In addition, the valve unit 80' further comprises a second discharge-side common channel 898 having a connection port 898A connected to a downstream port of the second branch channel 852 and to a downstream port of the second circulation channel 872, and an end port 898B directly connected to the second-side fluid channel 61.

Figure 9:
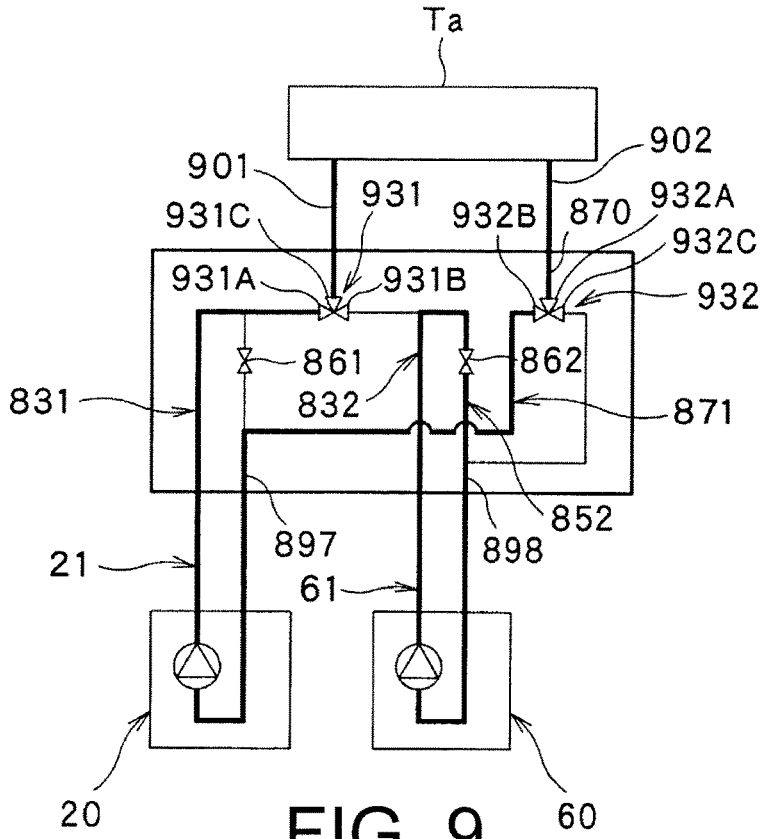
FIG. 9 is a view that explains an operation of a temperature control system including the valve unit according to the modification example shown in FIG. 8.
Figure 10:
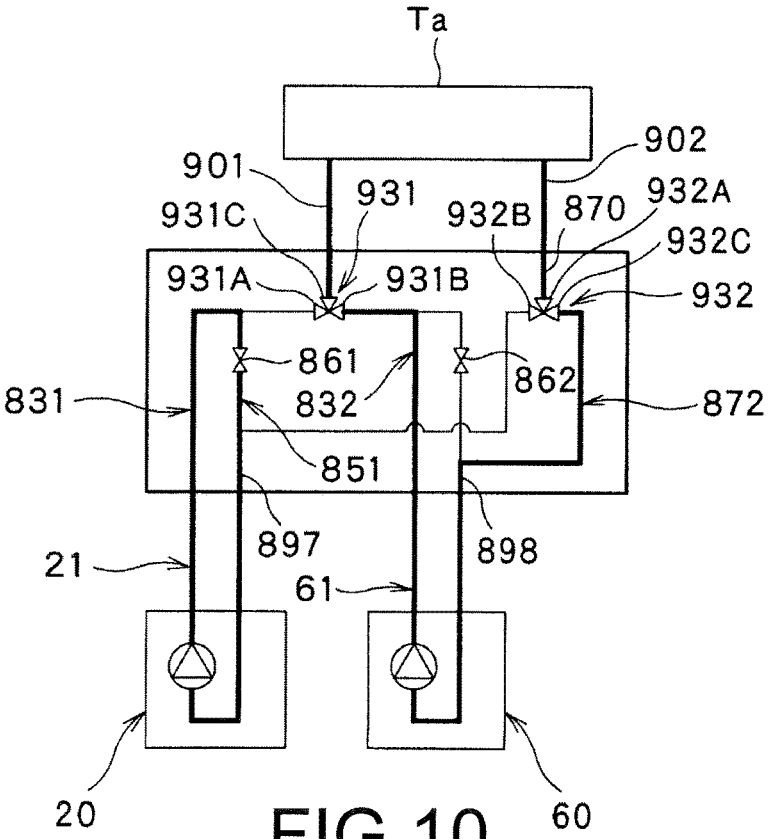
FIG. 10 is a view that explains the operation of a temperature control system including the valve unit according to the modification example shown in FIG. 8.

An operation of the valve unit 80' is described with reference to FIGS. 9 and 10. In the below description, similarly to the above embodiment, the respective valves in the valve unit 80' are operated in accordance with the control of the control device 90. In FIGS. 9 and 10, parts indicated by bold lines show locations through which a fluid flows.

When the first fluid is allowed to flow out from the supply-side outlet 931C, the supply-side channel switching three-way valve 931 fluidically connects the first fluid inlet 931A to the supply-side outlet 931C, and fluidically disconnects the second fluid inlet 931B from the supply-side outlet 931C. In addition, the circulation-side channel switching three-way valve 932 fluidically connects the circulation-side inlet 932A to the first outlet 932B, and fluidically disconnects the circulation-side inlet 932A from the second outlet 932C. Further, the first branch-side solenoid switching valve 861 is closed, and the second-branch-side solenoid switching valve 862 is opened.

At this time, as shown in FIG. 9, the first fluid flows from the first-side fluid channel 21 to the temperature control object Ta through the first supply channel 831 and the supply-side outlet 931C. Then, the first fluid flowing out from the temperature control object Ta flows to the reception channel 870 through the return-side relay channel 902. Thereafter, the first fluid returns to the first-side fluid channel 21 through the first outlet 932B, the first circulation channel 871 and the first discharge-side common channel 897. Meanwhile, the second fluid flowing out from the second-side fluid channel 61 is circulated in a closed circuit composed of the second-side fluid channel 61, a part of the second supply channel 832, the second branch channel 852 and the second discharge-side common channel 898.

On the other hand, when the second fluid is allowed to flow out from the supply-side outlet 931C, the supply-side channel switching three-way valve 931 fluidically disconnects the first fluid inlet 931A from the supply-side outlet 931C, and fluidically connects the second fluid inlet 931B to the supply-side outlet 931C. In addition, the circulation-side channel switching three-way valve 932 fluidically disconnects the circulation-side inlet 932A from the first outlet 932B, and fluidically connects the circulation-side inlet 932A to the second outlet 932C. Further, the first branch-side solenoid switching valve 861 is opened, and the second branch-side solenoid switching valve 862 is closed.

At this time, as shown in FIG. 10, the second fluid flowing out from the second-side fluid channel 61 flows from the second-side fluid channel 61 to the temperature control object Ta through the second supply channel 832 and the supply-side outlet 931C. Then, the second fluid flowing out from the temperature control object Ta flows to the reception channel 870 through the return-side relay channel 902. Thereafter, the second fluid returns to the second-side fluid channel 61 through the second outlet 932C, the second circulation channel 872 and the second discharge-side common channel 898. Meanwhile, the first fluid flowing out from the first-side fluid channel 21 is circulated in a closed circuit composed of the first-side fluid channel 21, a part of the first supply channel 831, the first branch channel 851 and the first discharge-side common channel 897.

Since the valve unit 80' according to the above modification example can have fewer valves as compared with the valves used in the valve unit 80 of the above-described embodiment, the valve unit 80' is advantageous in terms of assemblage and cost.

1 Temperature control system
2 Cooling water circulation circulation apparatus
2A Common pipe
2B First cooling pipe
2C Second cooling pipe
2D Third cooling pipe
10 First refrigerator unit
20 First fluid flow apparatus
21 First-side fluid channel
21U Upstream port
21D Downstream port
22 First-side pump
100 High-temperature-side refrigerator
101 High-temperature-side compressor
102 High-temperature-side condenser
103 High-temperature-side expansion valve
104 High-temperature-side evaporator
110 High-temperature-side refrigeration circuit
120 High-temperature-side hot gas circuit
121 Hot bas channel
122 Flowrate regulation valve
130 Cooling bypass circuit
131 Cooling channel
132 Cooling expansion valve
200 Medium-temperature-side refrigerator
201 Medium-temperature-side compressor
202 Medium-temperature-side condenser
203 Medium-temperature-side first expansion valve
204 Medium-temperature-side second first evaporator
210 Medium-temperature-side refrigeration circuit
220 Cascade bypass circuit
221 Branch channel
223 Medium-temperature-side second expansion valve
224 Medium-temperature-side second evaporator
230 Medium-temperature-side hot gas circuit
231 Hot gas channel
232 Flowrate regulation valve

240 Cascade cooling circuit
241 Cooling channel
243 Medium-temperature-side third expansion valve
300 Low-temperature-side refrigerator
301 Low-temperature-side compressor
302 Low-temperature-side condenser
303 Low-temperature-side expansion valve
304 Low-temperature-side evaporator
310 Low-temperature-side refrigeration circuit
311 First part
312 Second part
320 Low-temperature-side hot gas circuit
321 Hot gas channel
322 Flowrate regulation channel
40 Second Refrigerator unit
41 Second-side compressor
42 Second-side refrigeration circuit
43 Second-side expansion valve
44 Second-side evaporator
45 Second-side refrigeration circuit
50 Third refrigerator unit
51 Third-side compressor
52 Third-side compressor
53 Third-side expansion valve
54 Third-side evaporator
55 Third-side refrigeration circuit
60 Second fluid flow apparatus
61 Second-side fluid channel
61U Upstream port
61D Downstream port
62 Second-side pump
70 Third fluid flow apparatus
71 Third-side fluid channel
72 Third-side pump
80 Valve unit
831 First supply channel
831A First inlet port
831B First outlet port
832 Second supply channel
832A Second inlet port
832B Second outlet port
841 First supply-side solenoid switching valve
842 Second supply-side solenoid switching valve
851 First branch channel
852 Second branch channel
861 First branch-side solenoid switching valve
862 Second branch-side solenoid valve
870 Reception channel
871 First circulation channel
872 Second circulation channel
881 First circulation-side solenoid switching valve
882 Second circulation-side solenoid switching valve
891 First check valve
892 Second check valve
896 Supply-side common channel
896A Connection port
896B End port
897 First discharge-side common channel
897A Connection port
897B End port
898 Second discharge-side common channel
898A Connection port
898B End port
901 Supply-side relay channel
902 Return-side relay channel
90 Control device
CC1 First cascade condenser
CC2 Second cascade condenser
IE Internal heat exchanger
Ta Object whose temperature to be controlled (temperature control object)

What is claimed is:

1. A temperature control system comprising:

a first refrigerator unit;

a second refrigerator unit;

a first fluid flow apparatus that allows a first fluid to flow therethrough wherein the first fluid is cooled by the first refrigerator unit;

a second fluid flow apparatus that allows a second fluid to flow therethrough wherein the second fluid is cooled by the second refrigerator unit; and a valve unit that is configured to receive the first fluid from the first fluid flow apparatus and to receive the second fluid from the second fluid flow apparatus, and is configured to allow any of the first fluid and the second fluid to selectively flow out therefrom;

wherein:

the first refrigerator unit comprises:

a high-temperature-side refrigerator having a high-temperature-side refrigeration circuit in which a high-temperature-side compressor, a high-temperature-side condenser, a high-temperature-side expansion valve and a high-temperature-side evaporator are connected such that a high-temperature-side refrigerant circulates therethrough in this order;

a medium-temperature-side refrigerator having a medium-temperature-side circuit in which a medium-temperature-side compressor, a medium-temperature-side condenser, a medium-temperature-side first expansion valve and a medium-temperature-side first evaporator are connected such that a medium-temperature-side refrigerant circulates therethrough in this order, the medium-temperature-side refrigerator having a cascade bypass circuit including: a branch channel that is branched from a part of the medium-temperature-side refrigeration circuit, which part is on the downstream side of the medium-temperature-side condenser and on the upstream side of the medium-temperature-side first expansion valve, and is connected to a part which is on the downstream side of the medium-temperature-side first evaporator and on the upstream side of the medium-temperature-side compressor, the branch channel allowing the medium-temperature-side refrigerant branched from the medium-temperature-side refrigeration circuit to flow therethrough; a medium-temperature-side second expansion valve provided on the branch channel; and a medium-temperature-side second evaporator provided on the branch channel on the downstream side of the medium-temperature-side second expansion valve; and a low-temperature-side refrigerator having a low-temperature-side refrigeration circuit in which a low-temperature-side compressor, a low-temperature-side condenser, a low-temperature-side expansion valve and a low-temperature-side evaporator are connected such that a low-temperature-side refrigerant circulates therethrough in this order;

wherein:

the high-temperature-side evaporator of the high-temperature-side refrigerator and the medium-temperature-side condenser of the medium-temperature-side refrigerator constitute a first cascade condenser capable of heat-exchanging the high-temperature-side refrigerant with the medium-temperature-side refrigerant;

the medium-temperature-side second evaporator of the medium-temperature-side refrigerator and the low-temperature-side condenser of the low-temperature-side refrigerator constitute a second cascade condenser capable of heat-exchanging the medium-temperature-side refrigerant with the low-temperature-side refrigerant;

when cooling the first fluid, the first refrigerator unit is configured to open both the medium-temperature-side first expansion valve and the medium-temperature-side second expansion valve, so that the first fluid is cooled by the medium-temperature-side first evaporator of the medium-temperature-side refrigerator, and is then cooled by the low-temperature-side evaporator of the low-temperature-side refrigerator;

the second refrigerator unit has a second-side refrigeration circuit in which a second-side compressor, a second-side condenser, a second-side expansion valve and a second-side evaporator are connected such that a second-side refrigerant circulates therethrough in this order, the second refrigerator unit being configured to cool the second fluid by the second-side evaporator; and a boiling point of the low-temperature-side refrigerant is lower than a boiling point of the second-side refrigerant.

2. The temperature control system according to claim 1, wherein the valve unit has:

a first supply channel that allows the first fluid flowing into a first inlet port to flow therethrough and to flow out from a first outlet port;

a first supply-side solenoid switching valve that is switched between an opened state and a closed state, so as to switch flow and shut-off of the first fluid in the first supply channel;

a first branch channel that is branched from a part on the upstream side of the first supply-side solenoid switching valve of the first supply channel, the first branch channel allowing the first fluid flowing from the first supply channel to flow therethrough;

a first branch-side solenoid switching valve that is switched between an opened state and a closed state, so as to switch flow and shut-off of the first fluid in the first branch channel;

a second supply channel that allows the second fluid flowing into a second inlet port to flow therethrough and to flow out from a second outlet port;

a second supply-side solenoid switching valve that is switched between an opened state and a closed state, so as to switch flow and shut-off of the second fluid in the second supply channel;

a second branch channel that is branched from a part on the upstream side of the second supply-side solenoid switching valve of the second supply channel, the second branch channel allowing the second fluid flowing from the second supply channel to flow therethrough;

a second branch-side solenoid switching valve that is switched between an opened state and a closed state, so as to switch flow and shut-off of the second fluid in the second branch channel;

a reception channel that receives the first fluid that flows out from the first outlet port and then returns via a predetermined area, or the second fluid that flows out from the second outlet port and then returns via the predetermined area;

a first circulation channel and a second circulation channel that are biforked from the reception channel;

a first circulation-side solenoid switching valve that switches an opened state and a closed state of the first circulation channel; and a second circulation solenoid switching valve that switches an opened state and a closed state of the second circulation channel.

3. The temperature control system according to claim 1, wherein the medium-temperature-side refrigerator further has a cascade cooling circuit having: a cooling channel that is branched from a part of the medium-temperature-side refrigeration circuit, which part is on the downstream side of the medium-temperature-side condenser and on the upstream side of the medium-temperature-side first expansion valve, and is connected to a part of the cascade bypass circuit, which part is on the downstream side of the medium-temperature-side second evaporator, the cooling channel allowing the medium-temperature-side refrigerant branched from the medium-temperature-side refrigeration circuit to flow therethrough; and a medium-temperature-side third expansion valve provided on the cooling channel.

4. The temperature control system according to claim 1, further comprising a cooling water flow apparatus that allows cooling water to flow therethrough;

wherein:

the cooling water flow apparatus has a first cooling pipe and a second cooling pipe that are branched from a common pipe;

the high-temperature-side condenser cools the high-temperature-side refrigerant by the cooling water flowing out from the first cooling pipe; and the second-side condenser cools the second-side refrigerant by the cooling water flowing out from the second cooling pipe.

5. The temperature control system according to claim 4, further comprising:

a third refrigerator unit; and a third fluid flow apparatus that allows a third fluid to flow therethrough wherein the third fluid is cooled by the third refrigerator unit;

wherein:

the third refrigerator unit has a third-side refrigeration circuit in which a third-side compressor, a third-side condenser, a third-side expansion valve and a third-side evaporator are connected such that a third-side refrigerant circulates therethrough in this order, the third refrigerator unit being configured to cool the third fluid by the third-side evaporator;

the cooling water flow apparatus further has a third cooling pipe branched from the common pipe; and the third-side condenser cools the third-side refrigerant by means of the cooling water flowing out from the third cooling pipe.

6. The temperature control system according to claim 1, wherein the medium-temperature-side refrigerant and the low-temperature-side refrigerant are the same.

7. The temperature control system according to claim 6, wherein a part of the low-temperature-side refrigeration circuit, which part is on the downstream side of the low-temperature-side condenser and on the upstream side of the low-temperature-side expansion valve, and a part of the low-temperature-side refrigeration circuit, which part is on the downstream side of the low-temperature-side evaporator and on the upstream side of the low-temperature-side compressor, constitute an internal heat exchanger capable of heat-exchanging the low-temperature-side refrigerant passing through the former part with the low-temperature-side refrigerant passing through the latter part.

* * * * *